US007153642B2

(12) United States Patent
Aiba et al.

(10) Patent No.: US 7,153,642 B2
(45) Date of Patent: Dec. 26, 2006

(54) SILVER HALIDE PHOTOGRAPHIC EMULSION AND PHOTOTHERMOGRAPHIC MATERIAL USING THE SAME

(75) Inventors: Satoshi Aiba, Kanagawa (JP); Tadaaki Tani, Kanagawa (JP); Toshio Tsukada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 350 days.

(21) Appl. No.: 10/682,034

(22) Filed: Oct. 10, 2003

(65) Prior Publication Data

US 2004/0076913 A1 Apr. 22, 2004

(30) Foreign Application Priority Data

Oct. 11, 2002 (JP) ..... 2002-299173

(51) Int. Cl.
*G03C 1/005* (2006.01)

(52) U.S. Cl. ..... 430/567; 430/564; 430/617

(58) Field of Classification Search ..... 430/567, 430/564, 617
See application file for complete search history.

(56) References Cited

U.S. PATENT DOCUMENTS

| | | | | |
|---|---|---|---|---|
| 4,142,900 | A | 3/1979 | Maskasky | |
| 4,459,353 | A | 7/1984 | Maskasky | |
| 5,955,253 | A * | 9/1999 | Kawakami | 430/568 |

* cited by examiner

*Primary Examiner*—Geraldine Letscher
(74) *Attorney, Agent, or Firm*—Birch, Stewart, Kolasch & Birch, LLP

(57) ABSTRACT

A high silver iodide photographic emulsion is provides, which has a high sensitivity and a narrow size distribution, and is a photosensitive silver halide photographic emulsion having a silver iodide content of 90 mol % or more, wherein the average grain size (R) and the average crystallite size (r) of silver halide emulsion grains in the emulsion satisfy the relationship of $1 \leqq R/r < 2$.

14 Claims, No Drawings

SILVER HALIDE PHOTOGRAPHIC EMULSION AND PHOTOTHERMOGRAPHIC MATERIAL USING THE SAME

This nonprovisional application claims priority under 35 U.S.C. § 119(a) on Patent Application No. 2002-299173 filed in JAPAN on Oct. 11, 2002, which is herein incorporated by reference.

FIELD OF THE INVENTION

The present invention relates to a silver halide photographic emulsion having a high silver iodide content and also relates to a photothermographic silver halide material using the emulsion.

BACKGROUND OF THE INVENTION

Silver iodide has large light absorption in the blue exposure region as compared with silver chloride or silver bromide and this is a promising material for the elevation of sensitivity. However, because of difficulties in the development or chemical sensitization, silver iodide is scarcely used by itself as a photosensitive material, though a mixed crystal thereof is used. As for the technique of positively using silver iodide, U.S. patents by Joe E. Maskasky are known. These patents are mainly characterized by using silver iodide for epitaxially growing silver bromide or silver chloride on the silver iodide grain but the silver iodide grain itself has no particular feature as means for elevating the sensitivity (see, for example, U.S. Pat. No. 4,142,900). The characteristic features of silver iodide grain, which are desired for the elevation of sensitivity, are not yet clearly known.

In the thermal image-forming system using silver halide as a photocatalyst, the size of silver halide grain is preferably made small so as to obtain a high image quality with excellent sharpness and graininess. However, if the grain size is made small, this is accompanied by problems, that is, reduction in sensitivity, enlargement of size distribution and dissolution of grain.

SUMMARY OF THE INVENTION

Accordingly, an object of the present invention is to provide a high silver iodide photographic emulsion with high sensitivity and narrow size distribution and a photothermographic material using the emulsion.

As a result of extensive investigations, the present inventors have found that the above-described object can be effectively attained by the following techniques.

1. A photosensitive silver halide photographic emulsion having a silver iodide content of 90 mol % or more, wherein the average grain size (R) and the average crystallite size (r) of silver halide emulsion grains in the emulsion satisfy the relationship of $1 \leqq R/r < 2$.

2. The photosensitive silver halide photographic emulsion as described in the item 1, wherein the average grain size (R) and the average crystallite size (r) of silver halide emulsion grains in the emulsion satisfy the relationship of $1 \leqq R/r < 1.4$.

3. The photosensitive silver halide photographic emulsion as described in the item 1 or 2, wherein the silver halide emulsion grains in the emulsion contain silver halide emulsion grains having a β-type crystal structure in an amount of 50% or more.

4. The photosensitive silver halide photographic emulsion as described in any one of the items 1 to 3, wherein the average grain size (R) of the emulsion grains is 0.2 μm or less.

5. The photosensitive silver halide photographic emulsion as described in the items 4, wherein the average grain size (R) of the emulsion grains is 0.001 μm or more.

6. The photosensitive silver halide photographic emulsion as described in any one of the items 1 to 5, wherein the coefficient of variation in the average grain size is 20% or less.

7. A photothermographic material comprising a support having on the same surface thereof a photosensitive silver halide emulsion, a photo-insensitive organic silver salt, a heat developer and a binder, wherein the photosensitive silver halide emulsion comprises the silver halide photographic emulsion described in any one of the items 1 to 6.

DETAILED DESCRIPTION OF THE INVENTION

The present invention is described in detail below.

(Description of Silver Halide)

The photosensitive silver halide for use in the present invention may be silver iodide, silver chloroiodide, silver bromoiodide or silver chlorobromoiodide having a silver iodide content of 90 mol % or more. The silver iodide content is preferably 92 mol % or more, more preferably 95 mol % or more. The halogen composition in the grain may have a homogeneous distribution or may be stepwise or continuously changed. Also, a silver halide grain having a core/shell structure may be used. Furthermore, a technique of localizing silver bromide or silver chloride on the surface of silver chloroiodide, silver bromoiodide or silver chlorobromoiodide grain may be preferably employed.

The method for forming a photosensitive silver halide is well known in the art. For example, the methods described in *Research Disclosure*, No. 17029 (June, 1978) and U.S. Pat. No. 3,700,458 may be used. More specifically, a method of adding a silver-supplying compound and a halogen-supplying compound to gelatin or other polymer solution to prepare a photosensitive silver halide is used.

In order to bring out the effect of the present invention, the average grain size (R) of photosensitive silver halide is preferably small, specifically, from 0.001 to 0.20 μm, more preferably from 0.005 to 0.1 μm, still more preferably from 0.01 to 0.06 μm. The average grain size as used herein means an average value of diameters determined by converting the silver halide grain into a sphere having the same volume (called an equivalent-sphere diameter). The equivalent-sphere diameter may be determined, for example, by a light scattering method or from an electron microphotograph. The average value is usually determined by measuring 400 or more grains. The coefficient of variation in the average equivalent-sphere diameter (=a percentage of a value obtained by dividing the standard deviation of the equivalent-sphere diameter by the average equivalent-sphere diameter) of silver halide grains is preferably 20% or less, more preferably 10% or less.

The average crystallite size (r) of photosensitive silver halide can be determined by the following method.

First, a coated film comprising silver halide grain and gelatin is prepared (containing silver halide in an amount of 1 g/m$^2$ or more as silver). This coated film is thoroughly swelled with a 1:1 mixed solution of glycerin and water and then measured by an X-ray diffraction method using the Kα line of Cu for the line source to obtain diffraction peaks represented by plane indices (002), (110), (103) and (112). These four diffraction peaks each is determined on the half-width value for the strength and according to the Sheller's equation represented by formula 1, the crystallite size ($D_{hkl}$) is determined. This method is described in detail in Miyake, Tani and Nittono, *Nippon Shashin Gakkaishi* (*Journal of Japan Photographic Society*), Vol. 63, No. 1, pp. 4–11. The average crystallite size (r) indicates an average value of individual crystallite sizes ($D_{hkl}$) determined from four diffraction peaks.

$$D_{hkl}=K\lambda/\beta\cos\theta \qquad \text{Equation 1}$$

wherein $D_{hkl}$ is a crystallite size determined from the (hkl) face, λ is a wavelength of X-ray, β is a (half-width value) derived from the conditions inherent in the sample, θ is a black reflection angle on the (hkl) face, and K is a Sheller constant which is regarded as K=0.9 in the present invention.

It has been found that if the crystallite size (r) of a silver halide emulsion grain greatly differs from the average grain size (R), the internal sensitivity of this grain is high. When two grains in the same size are combined to form one grain, the crystallite size becomes almost a half of the grain size and at this time, many combined faces work out to an internal defect and seem to bring about the internal sensitivity. As the crystallite size (r) more greatly differs from the average grain size (R), the internal sensitivity is found to become higher. The increase of internal sensitivity disadvantageously gives rise to decrease in the surface sensitivity. Therefore, in the photosensitive silver halide emulsion grains of the present invention, the average grain size (R) and the crystallite size (r) preferably satisfy the relationship of $1 \leqq R/r < 2$, more preferably $1 \leqq R/r < 1.4$.

Examples of the shape of silver halide grain include a cubic form, an octahedral form, a tetradecahedral form, a tabular form, a spherical form, a bar-like form and a pebble-like form.

The photosensitive silver iodide grain is known to take two crystal structures of wurtzite type (β type) and zinc-blende type (γ type) at room temperature. The crystal structure of silver iodide grain can be examined by the X-ray diffraction measurement using a powder sample. In the present invention, the silver iodide grain is measured by using the Kβ line of copper for the line source of X-ray and from the diffraction intensity ratio between the plane index (331) peculiar to the γ-type silver iodide and the plane index (210) of β-type silver iodide, the percentage of existence of grains having a β-type crystal structure contained in the emulsion of the present invention is determined. That is, assuming that the diffraction intensity of (331) plane is A and the intensity of (210) plane is B, the percentage of existence is specified as a percentage of a value obtained by dividing B by the sum of A and B. In the silver halide emulsion constituted by photosensitive silver halide grains of the present invention, the percentage of existence of grains having a β-type crystal structure is preferably 50% or more, and most preferably 80% or more.

The photosensitive silver halide grain of the present invention may contain a metal belonging to Groups 8 to 10 of the Periodic Table (showing Groups 1 to 18) or a complex of the metal. The metal belonging to Groups 8 to 10 of the Periodic Table or the center metal of the metal complex is preferably rhodium, ruthenium or iridium. The metal complexes may be used individually or two or more complexes of similar metals or dissimilar metals may be used in combination. The content thereof is preferably from $1\times10^{-9}$ to $1\times10^{-3}$ mol per mol of silver. These heavy metals and metal complexes and the addition method therefor are described in JP-A-7-225449 (the term "JP-A" as used herein means an "unexamined published Japanese patent application"), JP-A-11-65021 (paragraphs 0018 to 0024) and JP-A-11-119374 (paragraphs 0227 to 0240).

Furthermore, the metal atom (for example, $[Fe(CN)_6]^{4-}$) which can be contained in the silver halide grain for use in the present invention, and the method for the desalting or chemical sensitization of silver halide emulsion are described in JP-A-11-84574 (paragraphs 0046 to 0050), JP-A-11-65021 (paragraphs 0025 to 0031) and JP-A-11-119374 (paragraphs 0242 to 0250).

The sensitizing dye which can be used in the present invention is preferably selected from sensitizing dyes capable of spectrally sensitizing a silver halide grain in a desired wavelength region when adsorbed to the silver halide grain and having spectral sensitivity suitable for the spectral characteristics of the exposure light source. The sensitizing dye and the addition method therefor are described in JP-A-11-65021 (paragraphs 0103 to 0109), JP-A-10-186572 (compounds represented by formula (II)), JP-A-11-119374 (dyes represented by formula (I) and paragraph 0106), U.S. Pat. Nos. 5,510,236 and 3,871,887 (dye described in Example 5), JP-A-2-96131, JP-A-59-48753, EP-A-0803764 (page 19, line 38 to page 20, line 35), JP-A-2001-272747 (Japanese Patent Application No. 2000-86865), JP-A-2001-290238 (Japanese Patent Application No. 2000-102560) and JP-A-2002-023306 (Japanese Patent Application No. 2000-205399). These sensitizing dyes may be used individually or in combination of two or more thereof. In the present invention, the sensitizing dye is preferably added to the silver halide emulsion in the time period after desalting until coating, more preferably after desalting until the completion of chemical ripening. In the present invention, the sensitizing dye may be added in a desired amount according to the performance such as sensitivity and fog, but the amount of the sensitizing dye added is preferably from $10^{-6}$ to 1 mol, more preferably from $10^{-4}$ to $10^{-1}$ mol, per mol of silver halide of the photosensitive layer.

In the present invention, a supersensitizer may be used for the purpose of increasing the spectral sensitization efficiency. Examples of the supersensitizer for use in the present invention include the compounds described in EP-A-587338, U.S. Pat. Nos. 3,877,943 and 4,873,184, JP-A-5-341432, JP-A-11-109547 and JP-A-10-111543.

The photosensitive silver halide grain for use in the present invention is preferably subjected to chemical sensitization by sulfur sensitization, selenium sensitization or tellurium sensitization. The compound which is preferably used in the sulfur, selenium or tellurium sensitization may be a known compound, for example, compounds described in JP-A-7-128768 can be used. In the present invention, tellurium sensitization is preferred and compounds described in JP-A-11-65021 (paragraph 0030) and compounds represented by formulae (II), (III) and (IV) of JP-A-5-313284 are more preferred.

The photosensitive silver halide grain for use in the present invention is preferably subjected to chemical sensitization by gold sensitization alone or in combination with the above-described chalcogen sensitization. The gold sensitizer preferably has a gold valence number of +1 or +3 and gold compounds commonly used as the gold sensitizer are preferably used. Representative examples thereof include chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyltrichlorogold. Also, gold sensitizers described in U.S. Pat. No. 5,858,637 and Japanese Patent Application No. 2001-79450 are preferably used.

In the present invention, the chemical sensitization may be performed at any step if it is after the grain formation and before the coating. For example, after the desalting, the chemical sensitization may be performed (1) before spectral sensitization, (2) simultaneously with spectral sensitization, (3) after spectral sensitization or (4) immediately before coating. In particular, the chemical sensitization is preferably performed at the spectral sensitization. The amount of sulfur, selenium or tellurium sensitizer used in the present invention varies depending on the silver halide grain used, chemical ripening conditions and the like, but the amount used is from $10^{-8}$ to $10^{-2}$ mol, preferably on the order of $10^{-7}$ to $10^{-3}$ mol, per mol of silver halide. The amount of the gold sensitizer added varies depending on various conditions but this is, as a standard, from $10^{-7}$ to $10^{-3}$ mol, preferably from $10^{-6}$ to $5\times10^{-4}$ mol, per mol of silver halide. In the present invention, the conditions for the chemical sensitization are not particularly limited but the pH is from 5 to 8, the pAg is from 6 to 11 and the temperature is approximately from 40 to 95° C. In the silver halide emulsion of the present invention, a thiosulfonic acid compound may be added by the method described in EP-A-293917.

The photosensitive silver halide grain for use in the present invention preferably uses a reducing agent. Specific preferred examples of the compound used for the reduction sensitization include ascorbic acid and thiourea dioxide. In addition, stannous chloride, amino-iminomethanesulfinic acid, hydrazine derivatives, borane compounds, silane compounds, polyamine compounds and the like are preferably used. The reduction sensitizer may be added at any step in the process of producing a photosensitive emulsion from the crystal growth to the preparation step immediately before coating. The reduction sensitization is preferably performed by ripening the emulsion while keeping the pH at 7 or more or pAg at 8.3 or less. It is also preferred to perform the reduction sensitization by introducing a single addition moiety of silver ion during the grain formation.

The photosensitive silver halide emulsion of the present invention preferably contains an FED sensitizer (fragmentable electron donating sensitizer) which generates two electrons with one photon. Preferred examples of the FED sensitizer include the compounds described in U.S. Pat. Nos. 5,747,235, 5,747,236, 6,054,260 and 5,994,051 and Japanese Patent Application No. 2001-86161. As for the step of adding the FED sensitizer, any step in the process of producing a photosensitive emulsion from the crystal growth to the preparation step immediately before coating is preferred. The amount added varies depending on various conditions but this is, as a standard, from $10^{-7}$ to $10^{-1}$ mol, preferably from $10^{-6}$ to $5\times10^{-2}$ mol, per mol of silver halide.

The silver halide emulsion of the present invention is applied to, for example, a color negative film, a color positive film, a color reversal film, a color reversal printing paper, a color printing paper or a photosensitive heat-developable photographic material for medical diagnosis or photographic technology. In particular, the silver halide emulsion of the present invention is preferably used for a photosensitive heat-developable photographic material.

The photosensitive heat-developable photographic material using an organic silver salt is described in detail below.

(Description of Organic Silver Salt)

The organic silver salt which can be used in the present invention is a silver salt relatively stable to light but capable of functioning as a silver ion-supplying material to form a silver image when heated at 80° C. or more in the presence of an exposed photosensitive silver halide and a reducing agent. The organic silver salt may be any organic substance capable of supplying a silver ion which can be reduced by a reducing agent. Such a photo-insensitive organic silver salt is described in JP-A-10-62899 (paragraphs 0048 to 0049), EP-A-0803764 (page 18, line 24 to page 19, line 37), EP-A-0962812, JP-A-11-349591, JP-A-2000-7683 and JP-A-2000-72711. The organic silver salt is preferably a silver salt of an organic acid, more preferably a silver salt of a long chain aliphatic carboxylic acid (having from 10 to 30 carbon atoms, preferably from 15 to 28 carbon atoms). Preferred examples of the fatty acid silver salt include silver lignocerate, silver behenate, silver arachidate, silver stearate, silver oleate, silver laurate, silver caproate, silver myristate, silver palmitate, erucic acid and mixtures thereof. Of these fatty acid silver salts, preferred in the present invention are fatty acid silver salts having a silver behenate content of 50 mol % or more, more preferably 85 mol % or more, still more preferably 95 mol % or more.

The shape of the organic silver salt which can be used in the present invention is not particularly limited and the organic silver salt may have any shape of needle form, bar form, tabular form or scaly form. In the present invention, the organic silver salt preferably has a scaly shape. In addition, an amorphous grain in the hour hand-like, rectangular parallelopiped, cubic or pebble-like shape having a length ratio of 5 or less between long axis and short axis is also preferably used. These organic silver gains are characterized by undergoing less fogging at the heat development as compared with the minute hand-like grain where the length ratio between the long axis and the short axis exceeds 5. In particular, a grain having a long axis and short axis ratio of 3 or less is preferred because the coated film is enhanced in the mechanical stability. In the present invention, the scaly organic silver salt is defined as follows. An organic silver salt grain is observed through an electron microscope and the shape of the organic silver salt grain is approximated to a rectangular parallelepiped. Assuming that the sides of the rectangular parallelepiped are a, b and c from the shortest side (c may be equal to b), x is calculated from the shorter numerical values a and b as follows:

$$x=b/a$$

Thus, x is determined on about 200 grains and assuming that the average value thereof is x (average), grains satisfying the relationship of x (average)≧1.5 are defined as a scaly grain. Those satisfying the relationship of 30≧x (average)≧1.5 are preferred and those satisfying the relationship of 20≧x (average)≧2.0 are more preferred. Incidentally, the needle-like grain is a grain satisfying the relationship of 1.5>x (average)≧1.

In the scaly grain, a can be regarded as a thickness of a tabular grain with the main plane being a plane having the sides of b and c. The average of a is preferably from 0.01 to 0.23 μm, more preferably from 0.1 to 0.20 μm. The average of c/b is preferably from 1 to 6, more preferably from 1.05 to 4, still more preferably from 1.1 to 3, particularly preferably from 1.1 to 2.

The grain size distribution of organic silver salt is preferably monodisperse. The term "monodisperse" as used herein means that a percentage of each value obtained by dividing the standard deviations of short axis length and long axis length by the short axis length and the long axis length, respectively, is preferably 100% or less, more preferably 80% or less, still more preferably 50% or less. The shape of the organic silver salt can be determined from a transmission electron microscope image of an organic silver salt dispersion. Another method for measuring the monodispersity is a method of determining a standard deviation of volume weighted average diameter of the organic silver salt. The percentage of a value (coefficient of variation) obtained by dividing the determined standard deviation by the volume weighted average diameter is preferably 100% or less, more preferably 80% or less, still more preferably 50% or less. The standard deviation can be determined from the grain size (volume weighted average diameter) obtained, for example, by irradiating a laser beam on the organic silver salt dispersed in a liquid and determining an autocorrelation function of fluctuation of the scattered light with respect to the time variation.

For the production and dispersion of the organic acid silver salt for use in the present invention, known methods may be used. Examples of the method include those described in JP-A-10-62899, EP-A-0803763, EP-A-0962812, JP-A-11-349591, JP-A-2000-7683, JP-A-2000-72711, JP-A-2001-163889 (Japanese Patent Application No. 11-348228), JP-A-2001-163890 (Japanese Patent Application No. 11-348229), JP-A-2001-163827 (Japanese Patent Application No. 11-348230), JP-A-2001-033907 (Japanese Patent Application No. 11-203413), JP-A-2001-188313 (Japanese Patent Application No. 2000-90093), JP-A-2001-083652 (Japanese Patent Application No. 2000-195621), JP-A-2002-006442 (Japanese Patent Application No. 2000-191226), JP-A-2002-031870 (Japanese Patent Application No. 2000-213813) and Japanese Patent Application No. 2000-214155.

If a photosensitive silver salt is present together at the dispersion of organic silver salt, fog increases and sensitivity seriously decreases. Therefore, it is preferred to contain substantially no photosensitive silver salt at the dispersion. In the present invention, the amount of the photosensitive silver salt dispersed in a water dispersion is preferably 1 mol % or less, more preferably 0.1 mol % or less, per mol of the organic silver acid silver salt in the solution. It is more preferred not to positively add the photosensitive silver salt.

In the present invention, a photosensitive material can be produced by mixing the organic silver salt water dispersion and the photosensitive silver salt water dispersion and the mixing ratio of the organic silver salt to the photosensitive silver salt can be selected according to the purpose, however, the ratio of the photosensitive silver salt to the organic silver salt is preferably from 1 to 30 mol %, more preferably from 2 to 20 mol %, still more preferably from 3 to 15 mol %. A method of using two or more organic silver salt water dispersions and two or more photosensitive silver salt water dispersions at the mixing is preferably employed for controlling the photographic properties.

In the present invention, the organic silver salt can be used in a desired amount but the amount added thereof is, in terms of the total coated silver amount including silver halide, preferably from 0.1 to 5.0 g/m$^2$, more preferably from 0.3 to 3.0 g/m$^2$, still more preferably from 0.5 to 2.0 g/m$^2$. Particularly, in order to enhance the image preservability, the total coated silver amount is preferably 1.8 g/m$^2$ or less, more preferably 1.6 g/m$^2$ or less. When the preferred reducing agent of the present invention is used, a sufficiently high image density can be obtained even with such a low silver amount.

(Description of Reducing Agent)

The photothermographic material of the present invention preferably contains a heat developer which is a reducing agent for the organic silver salt. The reducing agent for the organic silver salt may be any substance (preferably an organic substance) capable of reducing silver ion into metal silver. Examples of this reducing agent include those described in JP-A-11-65021 (paragraphs 0043 to 0045) and EP-A-0803764 (page 7, line 34 to page 18, line 12). In the present invention, the reducing agent is preferably a so-called hindered phenol-base reducing agent having a substituent at the ortho-position of the phenolic hydroxyl group or a bisphenol-base reducing agent, more preferably a compound represented by the following formula (R):

Formula (R):

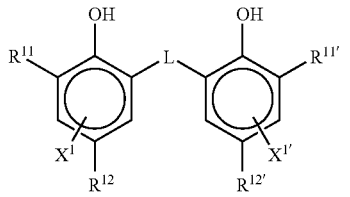

(wherein $R^{11}$ and $R^{11'}$ each independently represents an alkyl group having from 1 to 20 carbon atoms, $R^{12}$ and $R^{12'}$ each independently represents a hydrogen atom or a group substitutable on the benzene ring, L represents an —S— group or a —$CHR^{13}$— group, $R^{13}$ represents a hydrogen atom or an alkyl group having from 1 to 20 carbon atoms, and $X^1$ and $X^{1'}$ each independently represents a hydrogen atom or a group substitutable on the benzene ring).

Formula (R) is described in detail below. $R^{11}$ and $R^{11'}$ each is independently a substituted or unsubstituted alkyl group having from 1 to 20 carbon atoms. The substituent of the alkyl group is not particularly limited but preferred examples thereof include an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group and a halogen atom.

$R^{12}$ and $R^{12'}$ each independently represents a hydrogen atom or a group substitutable on the benzene ring. Also, $X^1$ and $X^{1'}$ each is represents a hydrogen atom or a group substitutable on the benzene ring. In both cases, preferred examples of the group substitutable on the benzene ring include an alkyl group, an aryl group, a halogen atom, an alkoxy group and an acylamino group.

L represents an —S— group or a —$CHR^{13}$— group. $R^{13}$ represents a hydrogen atom or an alkyl group having from 1 to 20 carbon atoms and the alkyl group may have a substituent. Specific examples of the unsubstituted alkyl group represented by $R^{13}$ include a methyl group, an ethyl group, a propyl group, a butyl group, a heptyl group, an undecyl group, an isopropyl group, a 1-ethylpentyl group and a 2,4,4-trimethylpentyl group. Examples of the substituent for the alkyl group are the same as those described above for the substituent of $R^{11}$.

$R^{11}$ and $R^{11'}$ each is preferably a secondary or tertiary alkyl group having from 3 to 15 carbon atoms. Specific examples thereof include an isopropyl group, an isobutyl group, a tert-butyl group, a tert-amyl group, a tert-octyl group, a cyclohexyl group, a cyclopentyl group, a 1-methylcyclohexyl group and a 1-methylcyclopropyl group. $R^{11}$ and $R^{11}$ each is more preferably a tertiary alkyl group having from 4 to 12 carbon atoms and among these, more preferred are a tert-butyl, a tert-amyl group and a 1-methylcyclohexyl group, and most preferred is a tert-butyl group.

$R^{12}$ and $R^{12'}$ each is preferably an alkyl group having from 1 to 20 carbon atoms and specific examples thereof include a methyl group, an ethyl group, a propyl group, a butyl group, an isopropyl group, a tert-butyl group, a tert-amyl group, a cyclohexyl group, a 1-methylcyclohexyl group, a benzyl group, a methoxymethyl group and a methoxyethyl group. Among these, more preferred are a methyl group, an ethyl group, a propyl group, an isopropyl group and a tert-butyl group. $X^1$ and $X^{1'}$ each is preferably a hydrogen atom, a halogen atom or an alkyl group, more preferably a hydrogen atom.

L is preferably a —$CHR^{13}$— group. $R^{13}$ is preferably a hydrogen atom or an alkyl group having from 1 to 15 carbon atoms. Preferred examples of the alkyl group include a methyl group, an ethyl group, a propyl group, an isopropyl group and a 2,4,4-trimethylpentyl group. $R^{13}$ is more preferably a hydrogen atom, a methyl group, an ethyl group, a propyl group or an isopropyl group.

When $R^{13}$ is a hydrogen atom, $R^{12}$ and $R^{12'}$ each is preferably an alkyl group having from 2 to 5 carbon atoms, more preferably an ethyl group or a propyl group, and most preferably an ethyl group.

When $R^{13}$ is a primary or secondary alkyl group having from 1 to 8 carbon atoms, $R^{12}$ and $R^{12'}$ each is preferably a methyl group. The primary or secondary alkyl group having from 1 to 8 carbon atoms represented by $R^{13}$ is preferably a methyl group, an ethyl group, a propyl group or an isopropyl group, more preferably a methyl group, an ethyl group or a propyl group. When $R^{11}$, $R^{11'}$, $R^{12}$ and $R^{12'}$ all are a methyl group, $R^{13}$ is preferably a secondary alkyl group. In this case, the secondary alkyl group represented by $R^{13}$ is preferably an isopropyl group, an isobutyl group or a 1-ethylpentyl group, more preferably an isopropyl group. Depending on the combination of $R^{11}$, $R^{11'}$, $R^{12}$, $R^{12'}$ and $R^{13}$ in the above-described reducing agent, the heat developability, developed silver tone and the like vary. These properties can be controlled by combining two or more reducing agents and therefore, depending on the purpose, two or more reducing agents are preferably used in combination.

Specific examples of the reducing agent for use in the present invention including the compound represented by formula (R) are set forth below, however, the present invention is not limited thereto.

(R-1)

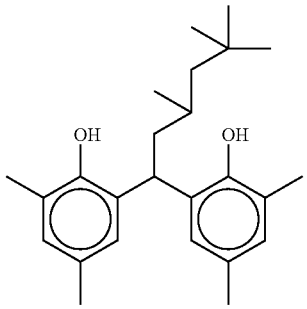

(R-2)

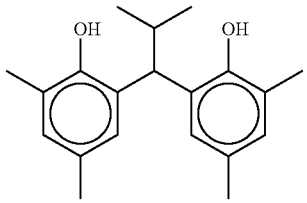

-continued
(R-3)
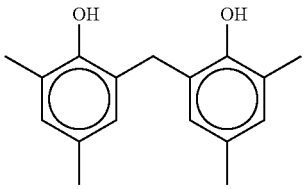
(R-4)
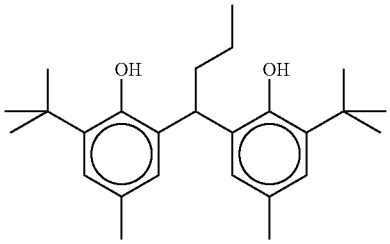
(R-5)
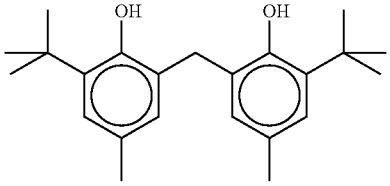
(R-6)
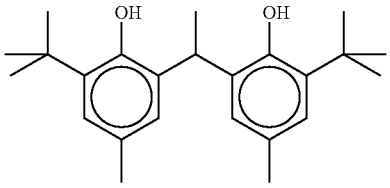
(R-7)
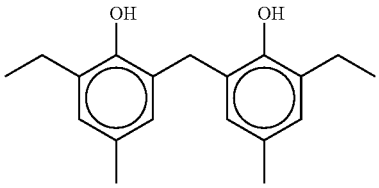
(R-8)
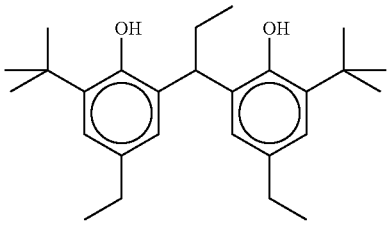
(R-9)
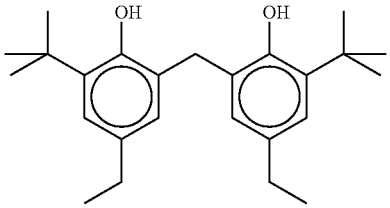
-continued
(R-10)
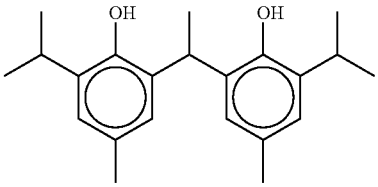
(R-11)
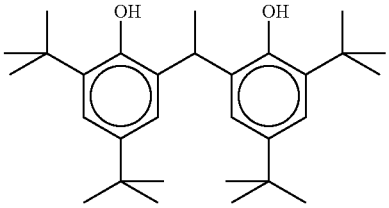
(R-12)
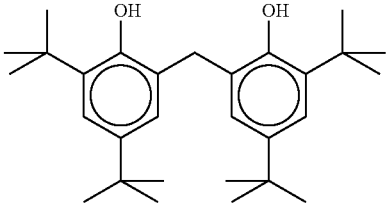
(R-13)
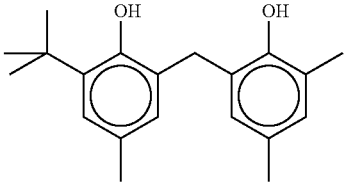
(R-14)
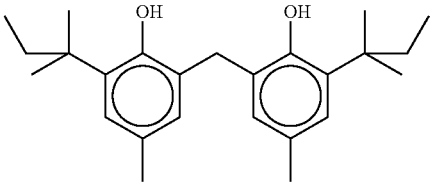
(R-15)
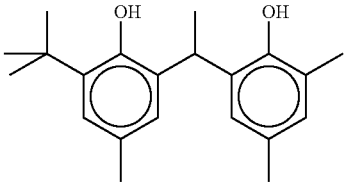
(R-16)
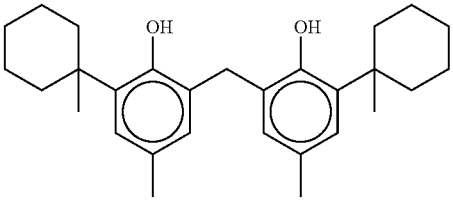

-continued
(R-17)
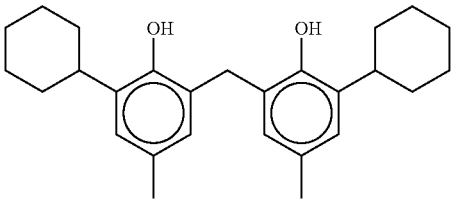
(R-18)
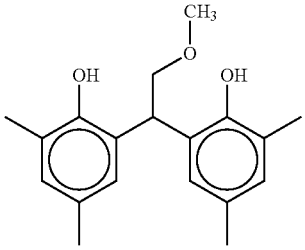
(R-19)
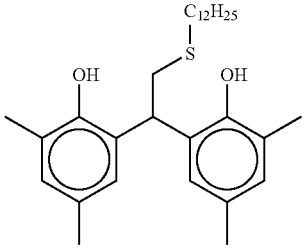
(R-20)
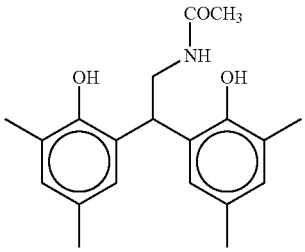
(R-21)
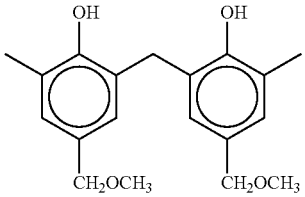
(R-22)
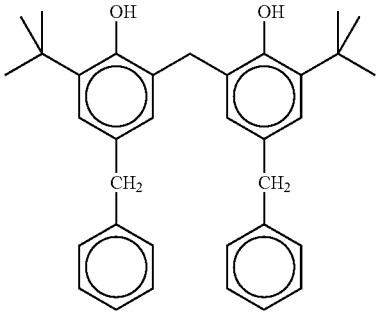
-continued
(R-23)
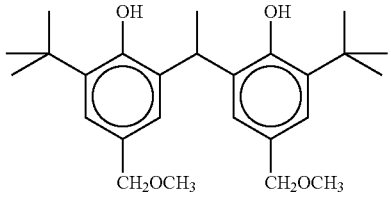
(R-24)
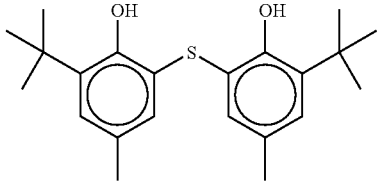
(R-25)
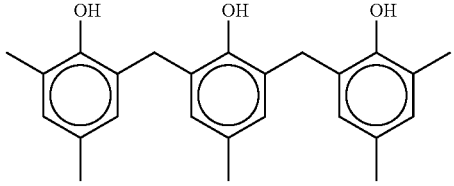
(R-26)
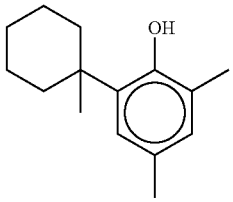
(R-27)
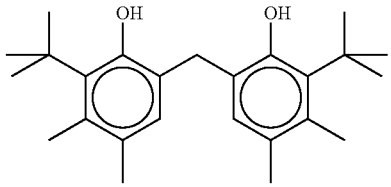
(R-28)
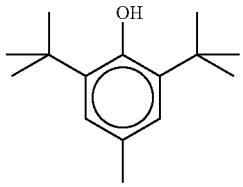
(R-29)
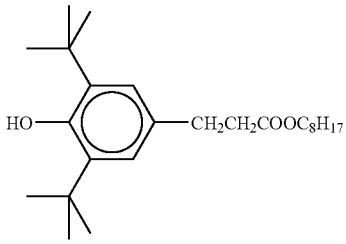

-continued (R-30)

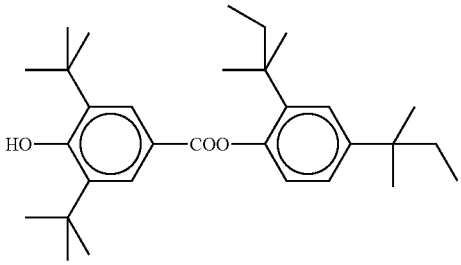

(R-31)

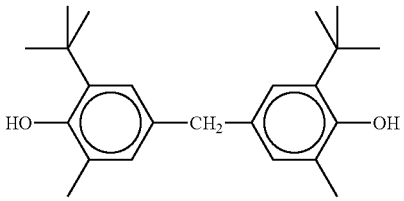

(R-32)

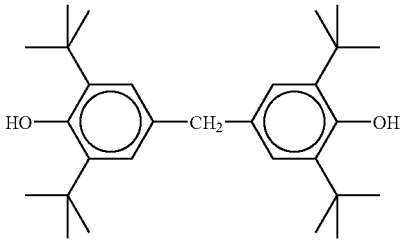

(R-33)

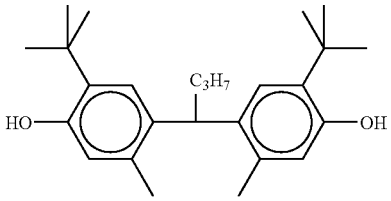

(R-34)

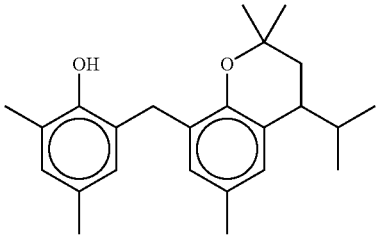

In the present invention, the amount of the reducing agent added is preferably from 0.1 to 3.0 g/m$^2$, more preferably from 0.2 to 1.5 g/m$^2$, still more preferably from 0.3 to 1.0 g/m$^2$. The reducing agent is preferably contained in an amount of 5 to 50 mol %, more preferably from 8 to 30 mol %, still more preferably from 10 to 20 mol %, per mol of silver on the surface having an image-forming layer. The reducing agent is preferably incorporated into an image-forming layer.

In adding the reducing agent to a coating solution and thereby incorporating it into the photosensitive material, the reducing agent may be added in any form, for example, in the form of a solution, an emulsified dispersion or a solid fine particle dispersion. Well-known examples of the emulsification dispersion method include a method of dissolving the reducing agent using an oil such as dibutyl phthalate, tricresyl phosphate, glyceryl triacetate or diethyl phthalate, and an auxiliary solvent such as ethyl acetate or cyclohexanone, and mechanically forming an emulsified dispersion.

Examples of the solid fine particle dispersion method include a method of dispersing the reducing agent in the powder form in an appropriate solvent such as water by using a ball mill, a colloid mill, a vibrating ball mill, a sand mill, a jet mill, a roller mill or an ultrasonic wave, thereby preparing a solid dispersion. At this time, a protective colloid (e.g., polyvinyl alcohol) or a surfactant (for example, an anionic surfactant such as sodium triisopropylnaphthalenesulfonate (a mixture of those differing in the substitution position of three isopropyl groups)) may be used. In the above-described mills, beads such as zirconia are commonly used as a dispersion medium and Zr or the like dissolved out from these beads may be mixed in the dispersion. The content thereof is usually from 1 to 1,000 ppm, though this varies depending on the dispersing conditions. It is not a problem in practice if the content of Zr in the photosensitive material is 0.5 mg or less per g of silver.

In the water dispersion, an antiseptic (e.g., benzoisothiazolinone sodium salt) is preferably added. In the present invention, the reducing agent is preferably used as a solid dispersion.

(Description of Development Accelerator)

The photothermographic material of the present invention preferably uses, as a development accelerator, a sulfonamidophenol-base compound represented by formula (A) of JP-A-2000-267222 and JP-A-2000-330234, a hindered phenol-base compound represented by formula (II) of JP-A-2001-92075, a hydrazine-base compound represented by formula (I) of JP-A-10-62895 and JP-A-11-15116 or formula (1) of Japanese Patent Application No. 2001-074278, or a phenol-base or naphthol-base compound represented by formula (2) of JP-A-2001-264929 (Japanese Patent Application No. 2000-76240). The development accelerator is used in the range from 0.1 to 20 mol %, preferably from 0.5 to 10 mol %, more preferably from 1 to 5 mol %, based on the reducing agent. The development accelerator may be introduced into the photosensitive material by the same method as those described above for the reducing agent but in particular, the development accelerator is preferably added as a solid dispersion or an emulsified dispersion. In the case of addition as an emulsified dispersion, the development accelerator is preferably added as an emulsified dispersion obtained by using a high boiling point solvent which is a solid at an ordinary temperature and a low boiling point auxiliary solvent, or as a so-called oilless emulsified dispersion using no high boiling point solvent. In the present invention, among those development accelerators, a hydrazine-base compound represented by formula (1) of Japanese Patent Application No. 2001-074278 and a phenol-base or naphthol-base compound represented by formula (2) of JP-A-2001-264929 (Japanese Patent Application No. 2000-76240) are more preferred.

Specific preferred examples of the development accelerator for use in the present invention are set forth below, however, the present invention is not limited thereto.

(A-1)

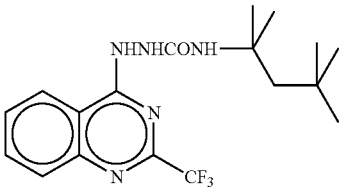

(A-2)

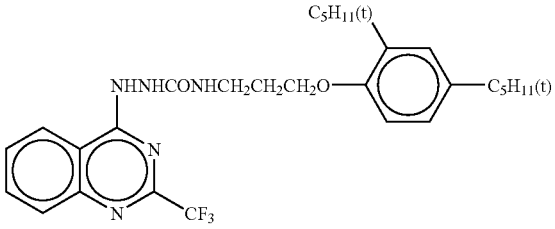

(A-3)

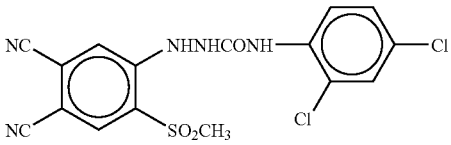

(A-4)

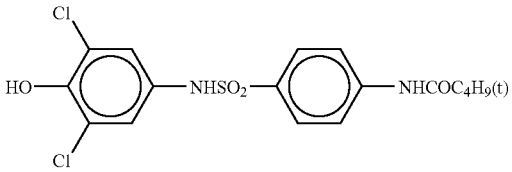

(A-5)

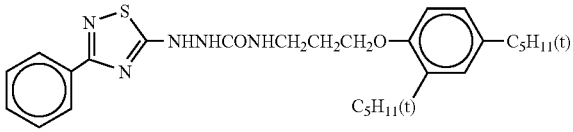

(A-6)

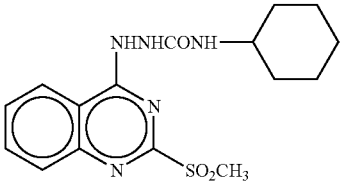

(A-7)

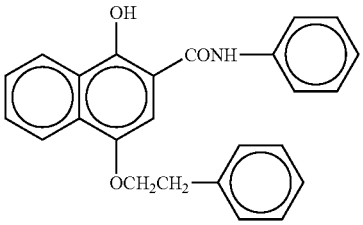

(A-8)

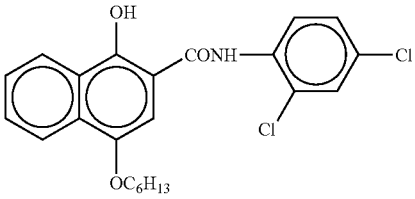

-continued (A-9)

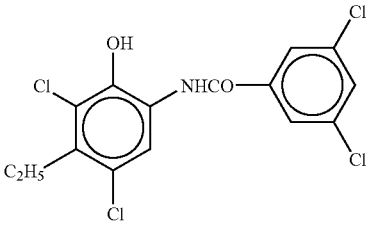

(A-10)

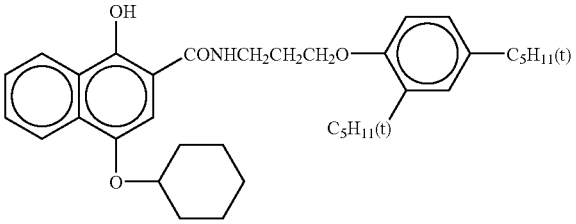

(Description of Hydrogen-Bonding Compound)

In the case where the reducing agent for use in the present invention has an aromatic hydroxyl group (—OH), particularly, in the case of a bisphenol described above, a non-reducing compound having a group capable of forming a hydrogen bond with the hydroxyl group is preferably used in combination. Examples of the group capable of forming a hydrogen bond with the hydroxyl group or amino group include a phosphoryl group, a sulfoxide group, a sulfonyl group, a carbonyl group, an amide group, an ester group, a urethane group, a ureido group, a tertiary amino group and a nitrogen-containing aromatic group. Among these, preferred are the compounds having a phosphoryl group, a sulfoxide group, an amide group (provided that this does not have a >N—H group and is blocked like >N—Ra (wherein Ra is a substituent except for H)), a urethane group (provided that this does not have a >N—H group and is blocked like >N—Ra (wherein Ra is a substituent except for H)) or a ureido group (provided that this does not have a >N—H group and is blocked like >N—Ra (wherein Ra is a substituent except for H)). In the present invention, the hydrogen-bonding compound is more preferably a compound represented by the following formula (D):

Formula (D):

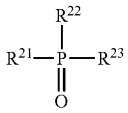

wherein $R^{21}$ to $R^{23}$ each independently represents an alkyl group, an aryl group, an alkoxy group, an aryloxy group, an amino group or a heterocyclic group and these groups each may be unsubstituted or may have a substituent. When the group represented by $R^{21}$ to $R^{23}$ has a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. The substituent is preferably an alkyl group or an aryl group and examples thereof include a methyl group, an ethyl group, an isopropyl group, a tert-butyl group, a tert-octyl group, a phenyl group, a 4-alkoxyphenyl group and a 4-acyloxyphenyl group.

Specific examples of the alkyl group represented by $R^{21}$ to $R^{23}$ include a methyl group, an ethyl group, a butyl group, an octyl group, a dodecyl group, an isopropyl group, a tert-butyl group, a tert-amyl group, a tert-octyl group, a cyclohexyl group, a 1-methylcyclohexyl group, a benzyl group, a phenethyl group and a 2-phenoxypropyl group. Specific examples of the aryl group include a phenyl group, a cresyl group, a xylyl group, a naphthyl group, a 4-tert-butylphenyl group, a 4-tert-octylphenyl group, a 4-anisidyl group and a 3,5-dichlorophenyl group. Specific examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group. Specific examples of the aryloxy group include a phenoxy group, a cresyloxy group, an isopropylphenoxy group, a 4-tert-butylphenoxy group, a naphthoxy group and a biphenyloxy group. Specific examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group. $R^{21}$ to $R^{23}$ each is preferably an alkyl group, an aryl group, an alkoxy group or an aryloxy group. In view of the effect of the present invention, it is preferred that at least one of $R^{21}$ to $R^{23}$ is an alkyl group or an aryl group, and it is more preferred that two or more are an alkyl group or an aryl group. From the standpoint that the compound can be inexpensively available, $R^{21}$ to $R^{23}$ are preferably the same group.

Specific examples of the hydrogen-bonding compound including the compound of formula (D) for use in the present invention are set forth below, however, the present invention is not limited thereto.

(D-1)

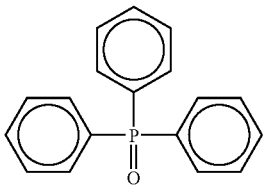

(D-2)

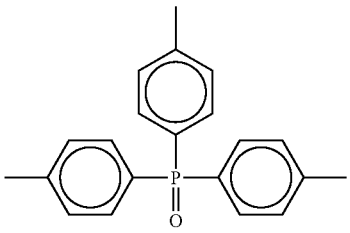

-continued (D-3)

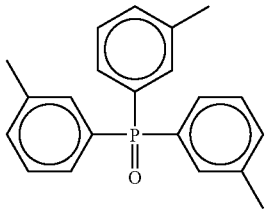

(D-4)

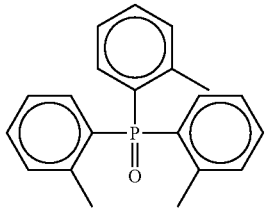

(D-5)

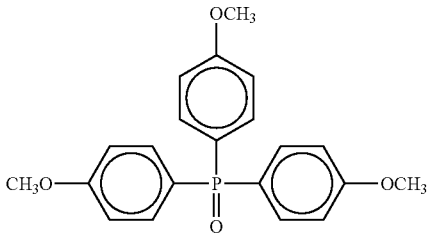

(D-6)

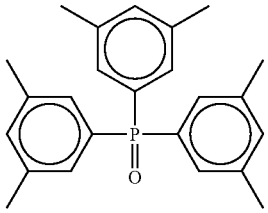

(D-7)

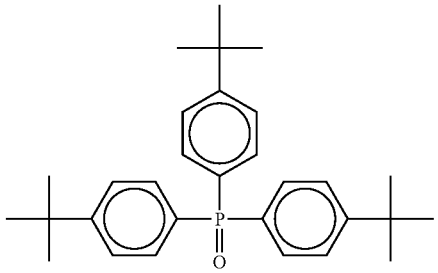

(D-8)

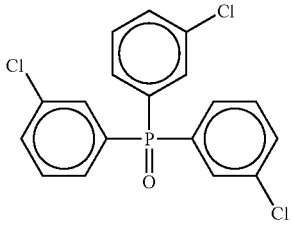

(D-9)

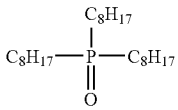

-continued (D-10)

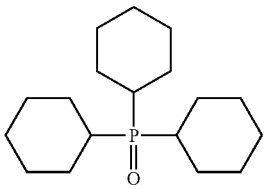

(D-11)

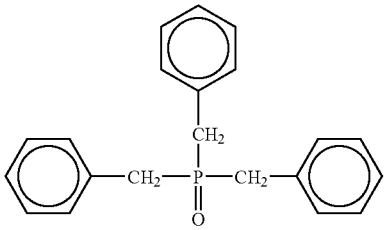

(D-12)

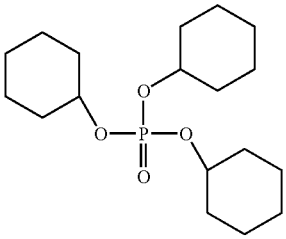

(D-13)

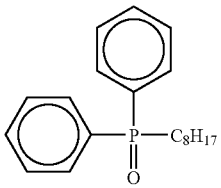

(D-14)

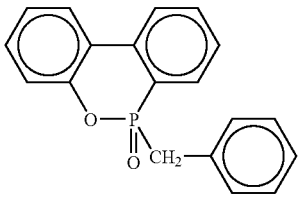

(D-15)

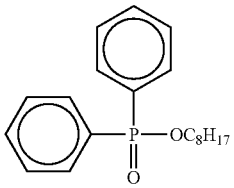

(D-16)

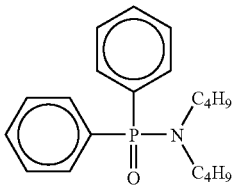

-continued (D-17)

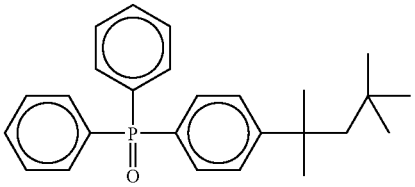

(D-18)

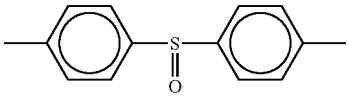

(D-19)

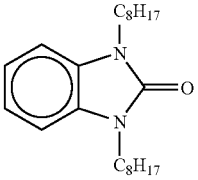

(D-20)

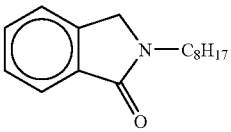

(D-21)

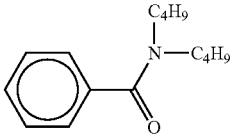

Specific examples of the hydrogen-bonding compound include, in addition to those described above, the compounds described in European Patent 1096310 and Japanese Patent Application Nos. 2000-270498 and 2001-124796. The compound of formula (D) for use in the present invention may be, similarly to the reducing agent, added in the form of a solution, an emulsified dispersion or a solid dispersion to the coating solution and incorporated into the photosensitive material but the compound is preferably used as a solid dispersion. When the compound for use in the present invention is in a solution state, this forms a hydrogen-bonding complex with a compound having a phenolic hydroxyl group or an amino group and depending on the combination of the reducing agent and the compound of formula (D) for use in the present invention, the complex can be isolated in the crystal state. The thus-isolated crystal powder is preferably used as a solid fine particle dispersion so as to obtain stable performance. Also, a method of mixing the reducing agent and the compound of formula (D) for use in the present invention each in the powder form and dispersing these by using an appropriate dispersant in a sand grinder mill or the like, thereby forming a complex, can be preferably used. The compound of formula (D) for use in the present invention is preferably used in the range from 1 to 200 mol %, more preferably from 10 to 150 mol %, still more preferably from 20 to 100 mol %, based on the reducing agent.

(Description of Silver Halide)

The method for forming a photosensitive silver halide is described above. Specifically, a method of adding a silver supply compound and a halogen supply compound to gelatin or other polymer solution to prepare a photosensitive silver halide and then mixing it with an organic silver salt is used. In addition, the methods described in JP-A-11-119374 (paragraphs 0217 to 0224), JP-A-11-352627 (Japanese Patent Application No. 11-98708) and JP-A-2000-347335 are also preferably used.

As the gelatin contained in the photosensitive silver halide emulsion of the present invention, various gelatins can be used. The photosensitive silver halide emulsion needs to be kept in a good dispersed state in the organic silver salt-containing coating solution and for this purpose, a gelatin having a molecular weight of 10,000 to 1,000,000 is preferably used. The gelatin may be used at the grain formation or at the dispersion after desalting but is preferably used at the grain formation.

In the photosensitive material of the present invention, one kind of photosensitive silver halide emulsion may be used or two or more kinds of photosensitive silver halide emulsions (for example, differing in the average grain size, differing in the halide composition, differing in the crystal habit or differing in the conditions of chemical sensitization) may be used in combination. The gradation can be controlled by using a plurality of photosensitive silver halides differing in the sensitivity. Examples of the technique thereon include those described in JP-A-57-119341, JP-A-53-106125, JP-A-47-3929, JP-A-48-55730, JP-A-46-5187, JP-A-50-73627 and JP-A-57-150841. With respect to the difference in sensitivity, a difference of 0.2 log E or more is preferably present between respective emulsions.

The amount of the photosensitive silver halide added is, in terms of the coated silver amount per $m^2$ of the photosensitive material, preferably from 0.03 to 0.6 $g/m^2$, more preferably from 0.07 to 0.4 $g/m^2$, and most preferably from 0.05 to 0.3 $g/m^2$. The amount of the photosensitive silver halide per mol of the organic silver salt is preferably from 0.01 to 0.5 mol, more preferably from 0.02 to 0.3 mol, still more preferably from 0.03 to 0.2 mol.

With respect to the mixing method and mixing conditions of the photosensitive silver halide and organic silver salt prepared separately, for example, a method where the silver halide grain and the organic silver salt each after the completion of preparation are mixed by means of a high-speed stirrer, a ball mill, a sand mill, a colloid mill, a vibration mill, a homogenizer or the like, or a method where at any timing during the preparation of the organic silver salt, the photosensitive silver halide after the completion of preparation is mixed, may be used. However, the mixing method and mixing conditions are not particularly limited insofar as the effect of the present invention can be fully brought out. A mixing method of mixing two or more organic silver salt water dispersions and two or more photosensitive silver salt water dispersions is preferred for the control of photographic properties.

The timing of adding the silver halide of the present invention to a coating solution for the image-forming layer is preferably from 180 minutes before coating to immediately before coating, preferably from 60 minutes to 10 seconds before coating. The mixing method and mixing conditions are not particularly limited insofar as the effect of the present invention can fully brought out. Specifically, a mixing method of mixing the silver halide with the coating solution in a tank controlled to give a desired average residence time which is calculated from the addition flow rate and the supply flow rate to a coater, or a method using a static mixer described in N. Harnby, M. F. Edwards and A. W. Nienow (translated by Kouji Takahashi), *Ekitai Kongou Gijutsu* (*Liquid Mixing Technology*), Chapter 8, Nikkan Kogyo Shinbun Sha (1989), may be used.

(Description of Binder)

In the present invention, the binder used for the organic silver salt-containing layer may be any polymer and the suitable binder is transparent or translucent and generally colorless. Examples thereof include natural resins and polymers and copolymers thereof; synthetic resins and polymers and copolymers thereof; and film-forming mediums such as gelatins, rubbers, poly(vinyl alcohols), hydroxyethyl celluloses, cellulose acetates, cellulose acetate butyrates, poly(vinylpyrrolidones), casein, starch, poly(acrylic acids), poly(methyl meth-acrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal), poly(vinyl butyral)), poly(esters), poly(urethanes), phenoxy resin, poly-(vinylidene chlorides), poly(epoxides), poly(carbonates), poly(vinyl acetates), poly(olefins), cellulose esters and poly(amides). The binder may also be coated and formed from water, an organic solvent or an emulsion.

In the present invention, the binder which can be used in combination in the organic silver salt-containing layer preferably has a glass transition temperature of 10 to 80° C. (hereinafter sometimes referred to as a "high Tg binder"), more preferably from 15 to 70° C., still more preferably from 20 to 65° C.

In the present invention, the Tg is calculated according to the following formula:

$$1/Tg=\Sigma(Xi/Tgi)$$

wherein assuming that the polymer is obtained by the copolymerization of n monomers from i=1 to i=n, Xi is a mass partial ratio of the i-th monomer ($\Sigma Xi=1$), Tgi is a glass transition temperature (absolute temperature) of a homopolymer of the i-th monomer, and $\Sigma$ is the sum total of from i=1 to i=n. As for the glass transition temperature value (Tgi) of a homopolymer of each monomer, the values described in J. Brandrup and E. H. Immergut, *Polymer Handbook,* 3rd Ed., Wiley-Interscience (1989) are adopted.

If desired, two or more binders may be used in combination. Also, a binder having a glass transition temperature of 20° C. or more and a binder having a glass transition temperature of less than 20° C. may be used in combination. In the case of blending two or more polymers differing in Tg, the mass average Tg thereof preferably falls within the above-described range.

In the present invention, the organic silver salt-containing layer is preferably formed by coating and drying a coating solution where 30 mass % or more of the solvent is water. In the present invention, the performance is enhanced when the organic silver salt-containing layer is formed by coating and drying a coating solution where 30 mass % or more of the solvent is water, and further when the binder in the organic silver salt-containing layer is soluble or dispersible in an aqueous solvent (water solvent), particularly when the binder comprises a polymer latex having an equilibrium moisture content of 2 mass % or less at 25° C. and 60% RH. In a most preferred embodiment, the binder is prepared to have an ion conductivity of 2.5 mS/cm or less. This may be prepared by purifying the polymer synthesized using a membrane having a separating function.

The aqueous solvent where the above-described polymer is soluble or dispersible is water or a solvent obtained by mixing 70 mass % or less of a water-miscible organic solvent with water. Examples of the water-miscible organic solvent include alcohol-base solvents such as methyl alcohol, ethyl alcohol and propyl alcohol, cellosolve-base solvents such as methyl cellosolve, ethyl cellosolve and butyl cellosolve, ethyl acetate, and dimethylformamide.

The term "aqueous solvent" is used here even in the case of a system where the polymer is not thermodynamically dissolved but is present in a so-called dispersed state.

The "equilibrium moisture content at 25° C. and 60% RH" can be expressed as follows by using the mass $W_1$ of a polymer in humidity equilibration in an atmosphere of 25° C. and 60% RH and the mass $W_0$ of a polymer in the bone dry state at 25° C.:

$$\text{Equilibrium moisture content at 25° C. and 60\% RH} = \{(W_1 - W_0)/W_0\} \times 100 \text{(mass \%)}$$

With respect to the definition and measuring method of moisture content, for example, *Bunshi Kogaku Koza* 14, *Kobunshi Zairyo Shiken Hou* (*Lecture* 14 *of Polymer Engineering, Polymer Material Testing Method*), compiled by Kobunshi Gakkai, Chijin Shokan, can be referred to.

The binder polymer for use in the present invention preferably has an equilibrium moisture content of 2 mass % or less, more preferably from 0.01 to 1.5 mass %, still more preferably from 0.02 to 1 mass %, at 25° C. and 60% RH.

In the present invention, a polymer dispersible in an aqueous solvent is particularly preferred. Examples of the dispersed state include a latex where water-insoluble hydrophobic polymer fine particles are dispersed, and a state where polymer molecules are dispersed in the molecular state or by forming micelles. The polymer may be dispersed in either state but a latex dispersed particle is more preferred. The average particle size of dispersed particles is from 1 to 50,000 nm, preferably from 5 to 1,000 nm, more preferably from 10 to 500 nm, still more preferably from 50 to 200 nm. The particle size distribution of dispersed particles is not particularly limited and the dispersed particles may have either a wide particle size distribution or a monodisperse particle size distribution. A method of using a mixture of two or more dispersions each having a monodisperse particle size distribution is also preferred in controlling the physical properties of the coating solution.

In the present invention, a preferred embodiment of the polymer dispersible in an aqueous solvent is a hydrophobic polymer such as acrylic polymers, poly(esters), rubbers (e.g., SBR resin), poly(urethanes), poly(vinyl chlorides), poly(vinyl acetates), poly(vinylidene chlorides) and poly (olefins). These polymers may be a linear, branched or crosslinked polymer and may also be a so-called homopolymer obtained by the polymerization of a single monomer or a copolymer obtained by the polymerization of two or more monomers. In the case of a copolymer, the copolymer may be a random copolymer or a block copolymer. The molecular weight of the polymer is, in terms of the number average molecular weight, from 5,000 to 1,000,000, preferably from 10,000 to 200,000. If the molecular weight is too small, the emulsion layer formed is insufficient in the mechanical strength, whereas if the molecular weight is excessively large, the film forming property is poor and this is not preferred. In particular, a crosslinkable polymer latex is preferably used.

(Specific Examples of Latex)

Specific preferred examples of the polymer latex include the followings. In the following, the polymer is expressed by using starting material monomers, the numerical value in the parenthesis is in the unit of mass %, and the molecular weight is a number average molecular weight. In the case of using a polyfunctional monomer, the concept of molecular weight cannot be employed because a crosslinked structure is formed, therefore, this is denoted as crosslinkable and the description of molecular weight is omitted. Tg indicates a glass transition temperature.

P-1: latex of -MMA(70)-EA(27)-MAA(3)-(molecular weight: 37,000, Tg: 61° C.)

P-2: latex of -MMA(70)-2EHA(20)-St(5)-AA(5)- (molecular weight: 40,000, Tg: 59° C.)

P-3: latex of -St(50)-Bu(47)-MAA(3)- (crosslinkable, Tg: −17° C.)

P-4: latex of -St(68)-Bu(29)-AA(3)- (crosslinkable, Tg: 17° C.)

P-5: latex of -St(71)-Bu(26)-AA(3)- (crosslinkable, Tg: 24° C.)

P-6: latex of -St(70)-Bu(27)-IA(3)- (crosslinkable)

P-7: latex of -St(75)-Bu(24)-AA(1)- (crosslinkable, Tg: 29° C.)

P-8: latex of -St(60)-Bu(35)-DVB(3)-MAA(2)- (crosslinkable)

P-9: latex of -St(70)-Bu(25)-DVB(2)-AA(3)- (crosslinkable)

P-10: latex of -VC(50)-MMA(20)-EA(20)-AN(5)-AA(5)–(molecular weight: 80,000)

P-11: latex of -VDC(85)-MMA(5)-EA(5)-MAA(5)- (molecular weight: 67,000)

P-12: latex of -Et(90)-MAA(10)- (molecular weight: 12,000)

P-13: latex of -St(70)-2EHA(27)-AA(3) (molecular weight: 130,000, Tg: 43° C.)

P-14: latex of -MMA(63)-EA(35)-AA(2) (molecular weight: 33,000, Tg: 47° C.)

P-15: latex of -St(70.5)-Bu(26.5)-AA(3)- (crosslinkable, Tg: 23° C.)

P-16: latex of -St(69.5)-Bu(27.5)-AA(3)- (crosslinkable, Tg: 20.5° C.)

In the above-described structures, the abbreviations indicate the following monomers: MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

These polymers are also commercially available and the following polymers may be used. Examples of the acrylic resin include Sebian A-4635, 4718, 4601 (all produced by Daicel Chemical Industries, Ltd.), Nipol Lx811, 814, 821, 820 and 857 (all produced by ZEON Corporation); examples of the poly(esters) include FINETEX ES650, 611, 675, 850 (all produced by Dai-Nippon Ink & Chemicals, Inc.), WD-size and WMS (all produced by Eastman Chemical Products, Inc.); examples of the poly(urethanes) include HYDRAN AP10, 20, 30, 40 (all produced by Dai-Nippon Ink & Chemicals, Inc.); examples of the rubbers include LACSTAR 7310K, 3307B, 4700H, 7132C (all produced by Dai-Nippon Ink & Chemicals, Inc.), Nipol Lx416, 410, 438C and 2507 (all produced by ZEON Corporation); examples of the poly(vinyl chlorides) include G351 and G576 (both produced by ZEON Corporation); examples of the poly(vinylidene chlorides) include L502 and L513 (both produced by Asahi Chemical Industry Co., Ltd.); and examples of the poly(olefins) include Chemipearl S120 and SA100 (produced by Mitsui Petrochemical Industries, Ltd.).

These polymer latexes may be used individually or as a blend of two or more thereof, if desired.

(Preferred Latex)

In particular, the polymer latex for use in the present invention is preferably a latex of styrene-butadiene copolymer. In the styrene-butadiene copolymer, the ratio by mass between the styrene monomer unit and the butadiene monomer unit is preferably from 40:60 to 95:5. Furthermore, the styrene monomer unit and the butadiene monomer unit preferably occupy from 60 to 99 mass % in the copolymer. Also, the polymer latex for use in the present invention preferably contains an acrylic or methacrylic acid in an amount of 1 to 6 mass %, more preferably from 2 to 5 mass %, based on the total of styrene and butadiene. The polymer latex for use in the present invention preferably contains an acrylic acid.

Examples of the styrene-butadiene copolymer latex which is preferably used in the present invention include the above-described P-3 to P-8 and P-15 and commercially available products LACSTAR-3307B, 7132C and Nipol Lx416.

The organic silver salt-containing layer of the photosensitive material of the present invention may contain, if desired, a hydrophilic polymer such as gelatin, polyvinyl alcohol, methyl cellulose, hydroxypropyl cellulose and carboxymethyl cellulose. The amount of the hydrophilic polymer added is preferably 30 mass % or less, more preferably 20 mass % or less, based on all binders in the organic silver salt-containing layer.

The organic silver salt-containing layer (namely, image-forming layer) of the present invention is preferably formed by using a polymer latex. The amount of the binder in the organic silver salt-containing layer is, in terms of the ratio by mass of all binders/organic silver salt, from 1/10 to 10/1, preferably from 1/3 to 5/1, more preferably from 1/1 to 3/1.

The organic silver salt-containing layer is usually also a photosensitive layer (emulsion layer) containing a photosensitive silver halide which is a photosensitive silver salt. In this case, the ratio by mass of all binders/silver halide is from 400 to 5, preferably from 200 to 10.

In the present invention, the entire binder amount of the image-forming layer is preferably from 0.2 to 30 g/m$^2$, more preferably from 1 to 15 g/m$^2$, still more preferably from 2 to 10 g/m$^2$. In the present invention, the image-forming layer may contain a crosslinking agent for forming a crosslinked structure or a surfactant for improving the coatability.

(Preferred Solvent for Coating Solution)

In the present invention, the solvent (for the sake of simplicity, the solvent and the dispersion medium are here collectively called a solvent) in the coating solution for the organic silver salt-containing layer of the photosensitive material is preferably an aqueous solvent containing 30 mass % or more of water. As for the component other than water, an optional water-miscible organic solvent may be used, such as methyl alcohol, ethyl alcohol, isopropyl alcohol, methyl cellosolve, ethyl cellosolve, dimethylformamide and ethyl acetate. The solvent of the coating solution preferably has a water content of 50 mass % or more, more preferably 70 mass % or more. Preferred examples of the solvent composition include, in addition to water, water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (the numerals are in mass %).

(Description of Antifoggant)

Examples of the antifoggant, stabilizer and stabilizer precursor which can be used in the present invention include those described in JP-A-10-62899 (paragraph 0070) and EP-A-0803764 (page 20, line 57 to page 21, line 7), and compounds described in JP-A-9-281637, JP-A-9-329864, U.S. Pat. No. 6,083,681 and European Patent 1048975. The antifoggant for use in the present invention is preferably an organic halide and examples thereof include those disclosed in the patents cited in JP-A-11-65021 (paragraphs 0111 to 0112). In particular, organic halogen compounds represented by formula (P) of JP-A-2000-284399, organic polyhalogen compounds represented by formula (II) of JP-A-10-339934, and organic polyhalogen compounds described in JP-A-2001-31644 and JP-A-2001-33911 are preferred.

(Description of Polyhalogen Compound)

The organic polyhalogen compound which is preferred in the present invention is specifically described below. The polyhalogen compound for use in the present invention is preferably a compound represented by the following formula (H):

$$Q\text{-}(Y)_n\text{—}C(Z_1)(Z_2)X \qquad (H)$$

wherein Q represents an alkyl group, an aryl group or a heterocyclic group, Y represents a divalent linking group, n represents 0 or 1, $Z_1$ and $Z_2$ each represents a halogen atom and X represents a hydrogen atom or an electron-withdrawing group.

In formula (H), Q is preferably an aryl group or a heterocyclic group.

In formula (H), when Q is a heterocyclic group, Q is preferably a nitrogen-containing heterocyclic group having one or two nitrogen atoms, more preferably a 2-pyridyl group or a 2-quinolyl group.

In formula (H), when Q is an aryl group, Q is preferably a phenyl group substituted by an electron-withdrawing group having a Hammett's substituent constant σp of a positive value. The Hammett's substituent constant is described, for example, in *Journal of Medicinal Chemistry*, Vol. 16, No. 11, 1207–1216 (1973). Examples of such an electron-withdrawing group include halogen atoms (e.g., fluorine (σp: 0.06), chlorine (σp: 0.23), bromine (σp: 0.23), iodine (σp: 0.18)), trihalomethyl groups (e.g., tribromomethyl (σp: 0.29), trichloromethyl (σp: 0.33), trifluoromethyl (σp: 0.54)), a cyano group (σp: 0.66), a nitro group (σp: 0.78), aliphatic•aryl or heterocyclic sulfonyl groups (e.g., methanesulfonyl (σp: 0.72)), aliphatic•aryl or heterocyclic acyl groups (e.g., acetyl (σp: 0.50), benzoyl (σp: 0.43)), alkynyl groups (e.g., C≡CH (σp: 0.23)), aliphatic•aryl or heterocyclic oxycarbonyl groups (e.g., methoxycarbonyl (σp: 0.45), phenoxycarbonyl (σp: 0.44)), a carbamoyl group (σp: 0.36), a sulfamoyl group (σp: 0.57), a sulfoxide group, a heterocyclic group and a phosphoryl group. The up value is preferably from 0.2 to 2.0, more preferably from 0.4 to 1.0. Among these electron-withdrawing groups, preferred are a carbamoyl group, an alkoxycarbonyl group, an alkylsulfonyl group and an alkylphosphoryl group, and most preferred is a carbamoyl group.

X is preferably an electron-withdrawing group, more preferably a halogen atom, an aliphatic•aryl or heterocyclic sulfonyl group, an aliphatic•aryl or heterocyclic acyl group, an aliphatic•aryl or heterocyclic oxycarbonyl group, a carbamoyl group or a sulfamoyl group, still more preferably a halogen atom. Among the halogen atoms, preferred are chlorine, bromine and iodine, more preferred are chlorine and bromine, and still more preferred is bromine.

Y is preferably —C(=O)—, —SO— or —$SO_2$—, more preferably —C(=O)— or —$SO_2$—, still more preferably —$SO_2$—. n represents 0 or 1, preferably 1.

Specific examples of the compound represented by formula (H) of the present invention are set forth below.

(H-1)

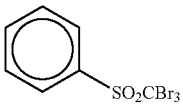

(H-2)

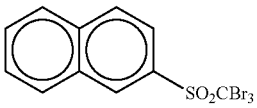

(H-3)

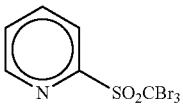

-continued (H-4)

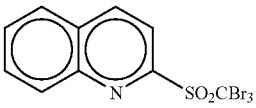

(H-5)

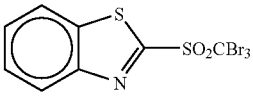

(H-6)

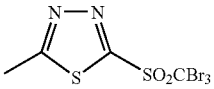

(H-7)

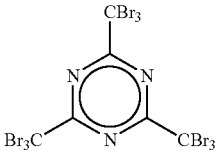

(H-8)

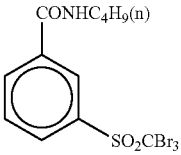

(H-9)

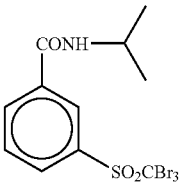

(H-10)

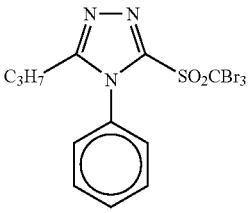

(H-11)

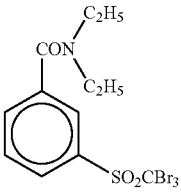

(H-12)

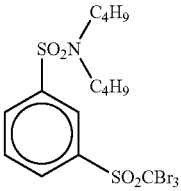

-continued (H-13)

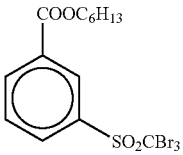

(H-14)

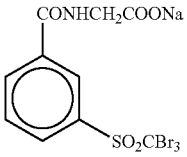

(H-15)

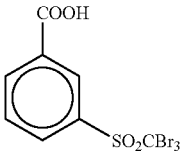

(H-16)

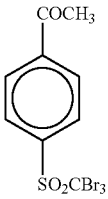

(H-17)

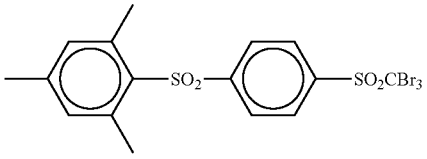

(H-18)

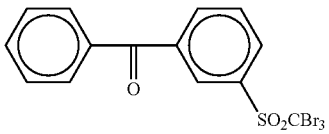

(H-19)

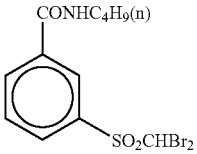

(H-20)

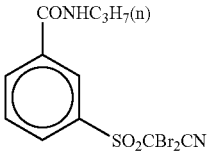

(H-21)

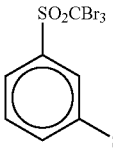

-continued (H-22)

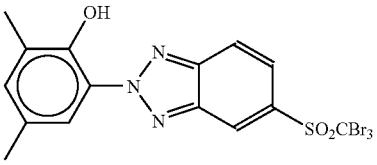

(H-23)

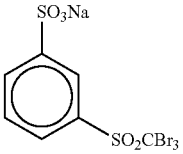

(H-24)

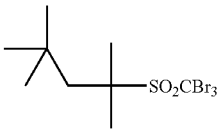

The compound represented by formula (H) of the present invention is preferably used in the range from $10^{-4}$ to 1 mol, more preferably from $10^{-3}$ to 0.5 mol, still more preferably from $1\times10^{-2}$ to 0.2 mol, per mol of the photo-insensitive silver salt in the image-forming layer.

In the present invention, for incorporating the antifoggant into the photosensitive material, the methods described above for the incorporation of a reducing agent may be used. The organic polyhalogen compound is also preferably added in the form of a solid fine particle dispersion.

(Other Antifoggants)

Other examples of the antifoggant include mercury(II) salts described in JP-A-11-65021 (paragraph 0113), benzoic acids described in the same patent publication (paragraph 0114), salicylic acid derivatives described in JP-A-2000-206642, formalin scavenger compounds represented by formula (S) of JP-A-2000-221634, triazine compounds according to claim 9 of JP-A-11-352624, compounds represented by formula (III) of JP-A-6-11791, and 4-hydroxy-6-methyl-1,3,3a,7-tetrazaindene.

The photothermographic material of the present invention may contain an azolium salt for the purpose of preventing fogging. Examples of the azolium salt include compounds represented by formula (XI) of JP-A-59-193447, compounds described in JP-B-55-12581 (the term "JP-B" as used herein means an "examined Japanese patent publication"), and compounds represented by formula (II) of JP-A-60-153039. The azolium salt may be added to any site of the photosensitive material but is preferably added to a layer on the surface having a photosensitive layer, more preferably to the organic silver salt-containing layer. The azolium salt may be added in any step during the preparation of a coating solution. In the case of adding the azolium salt to the organic silver salt-containing layer, the salt may be added in any step during the preparation of the organic silver salt and the preparation of the coating solution, but this is preferably added in a step after the preparation of the organic silver salt and immediately before the coating. The azolium salt may be added in any form such as powder, solution or fine particle dispersion, and may also be added as a solution having mixed therein other additive(s) such as sensitizing dye, reducing agent and color toning agent. In the present invention, the azolium salt may be added in any amount but the amount added is preferably from $1\times10^{-6}$ to 2 mol, more preferably from $1\times10^{-3}$ to 0.5 mol, per mol of silver.

In the present invention, a mercapto compound, a disulfide compound or a thione compound may be incorporated so as to control the development by preventing or accelerating the development, enhance the spectral sensitization efficiency or improve the storability before or after the development. Examples of these compounds include compounds described in JP-A-10-62899 (paragraphs 0067 to 0069), compounds represented by formula (I) and specific examples thereof in paragraphs 0033 to 0052 of JP-A-10-186572, and compounds described in EP-A-0803764 (page 20, lines 36 to 56). Among these, mercapto-substituted heteroaromatic compounds described in JP-A-9-297367, JP-A-9-304875, JP-A-2001-100358 and Japanese Patent Application Nos. 2001-104213 and 2001-104214 are preferred.

(Description of Color Toning Agent)

A color toning agent is preferably added to the photothermographic material of the present invention and the color toning agent is described in JP-A-10-62899 (paragraphs 0054 to 0055), EP-A-0803764 (page 21, lines 23 to 48), JP-A-2000-356317 and Japanese Patent Application No. 2000-187298. In particular, preferred examples thereof include phthalazinones (phthalazinone, phthalazinone derivatives, and metal salts of phthalazinone, e.g., 4-(1-naphthyl)phthalazinone, 6-chlorophthalazinone, 5,7-dimethoxyphthalazinone, 2,3-dihydro-1,4-phthalazinedione); combinations of a phthalazinone and a phthalic acid (e.g., phthalic acid, 4-methylphthalic acid, 4-nitrophthalic acid, diammonium phthalate, sodium phthalate, potassium phthalate, tetrachlorophthalic anhydride); phthalazines (phthalazine, phthalazine derivatives, and metal salts of phthalazine, e.g., 4-(1-naphthyl)phthalazine, 6-isopropylphthalazine, 6-tert-butylphthalazine, 6-chlorophthalazine, 5,7-dimethoxyphthalazine, 2,3-dihydrophthalazine); and combinations of a phthalazine and a phthalic acid. Among these, more preferred are combinations of a phthalazine and a phthalic acid, and still more preferred is a combination of 6-isopropylphthalazine and phthalic acid or 4-methylphthalic acid.

(Other Additives)

The plasticizer and lubricant which can be used in the photosensitive layer of the present invention are described in JP-A-11-65021 (paragraph 0117); the ultrahigh contrast-providing agent for the formation of an ultrahigh contrast image and the addition method and amount added thereof are described in JP-A-11-65021 supra (paragraph 0118), JP-A-11-223898 (paragraphs 0136 to 0193), JP-A-2000-284399 (compounds represented by formula (H), formulae (1) to (3) and formulae (A) and (B)) and Japanese Patent Application No. 11-91652 (compounds represented by formulae (III) to (V), specific compounds of Chem. 21 to Chem. 24); and the contrast-promoting agent is described in JP-A-11-65021 (paragraph 0102) and JP-A-11-223898 (paragraphs 0194 to 0195).

In the case of using a formic acid or a formate as a strong fogging substance, this is preferably incorporated into the side having an image-forming layer containing the photosensitive silver halide and contained in an amount of 5 mmol or less, preferably 1 mmol or less, per mol of silver.

In the case of using an ultrahigh contrast-providing agent in the photothermographic material of the present invention, an acid resulting from hydration of diphosphorus pentoxide, or a salt thereof is preferably used in combination. Examples of the acid resulting from hydration of diphosphorus pentoxide, and the salt thereof include metaphosphoric acid (and salts thereof), pyrophosphoric acid (and salts thereof), orthophosphoric acid (and salts thereof), triphosphoric acid (and salts thereof), tetraphosphoric acid (and salts thereof) and hexametaphosphoric acid (and salts thereof). Among these, preferred are orthophosphoric acid (and salts thereof) and hexametaphosphoric acid (and salts thereof). Specific examples of the salt include sodium orthophosphate, sodium dihydrogenorthophosphate, sodium hexametaphosphate and ammonium hexametaphosphate.

The acid resulting from hydration of diphosphorus pentoxide, or a salt thereof may be added in a desired amount according to the performance such as sensitivity and fog, but the amount used (coated amount per $m^2$ of the photosensitive material) is preferably from 0.1 to 500 $mg/m^2$, more preferably from 0.5 to 100 $mg/m^2$.

(Description of Layer Structure)

In the photothermographic material of the present invention, a surface protective layer may be provided so as to prevent the adhesion of the image-forming layer. The surface protective layer may be a single layer or may be composed of multiple layers. The surface protective layer is described in JP-A-11-65021 (paragraphs 0119 to 0120) and JP-A-2001-348546 (Japanese Patent Application No. 2000-171936).

In the present invention, the binder for the surface protective layer is preferably gelatin but polyvinyl alcohol (PVA) is also preferably used or used in combination with gelatin. Examples of the gelatin which can be used include inert gelatin (e.g., Nitta Gelatin 750) and phthalated gelatin (e.g., Nitta Gelatin 801). Examples of PVA include those described in JP-A-2000-171936 (paragraphs 0009 to 0020) and preferred examples thereof include completely saponified product PVA-105, partially saponified products PVA-205 and PVA-335, and modified polyvinyl alcohol MP-203 (all are trade names, produced by Kuraray Co., Ltd.). In the protective layer (per one layer), the amount of polyvinyl alcohol coated (per $m^2$ of the support) is preferably from 0.3 to 4.0 $g/m^2$, more preferably from 0.3 to 2.0 $g/m^2$.

Particularly, in the case of using the photothermographic material of the present invention for printing where the dimensional change becomes a problem, a polymer latex is preferably used for the surface protective layer or the back layer. The polymer latex for this purpose is described in Taira Okuda and Hiroshi Inagaki (compilers), *Gosei Jushi Emulsion* (*Synthetic Resin Emulsion*), Kobunshi Kankokai (1978), Takaaki Sugimura, Yasuo Kataoka, Soichi Suzuki and Keishi Kasahara (compilers), *Gosei Latex no Oyo* (*Application of Synthetic Latex*), Kobunshi Kankokai (1993), and Soichi Muroi, *Gosei Latex no Kagaku* (*Chem-*

*istry of Synthetic Latex*), Kobunshi Kankokai (1970). Specific examples of the polymer latex include a latex of methyl methacrylate (33.5 mass %)/ethyl acrylate (50 mass %)/methacrylic acid (16.5 mass %) copolymer, a latex of methyl methacrylate (47.5 mass %)/butadiene (47.5 mass %)/itaconic acid (5 mass %) copolymer, a latex of ethyl acrylate/methacrylic acid copolymer, a latex of methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer and a latex of methyl methacrylate (64.0 mass %)/styrene (9.0 mass %)/butyl acrylate (20.0 mass %)/2-hydroxyethyl methacrylate (5.0 mass %)/acrylic acid (2.0 mass %) copolymer. To the binder of the surface protective layer, a combination of polymer latexes described in Japanese Patent Application No. 11-6872, and techniques described in JP-A-2000-267226 (Japanese Patent Application No. 11-143058, paragraphs 0021 to 0025), Japanese Patent Application No. 11-6872 (paragraphs 0027 to 0028) and JP-A-2000-019678 (Japanese Patent Application No. 10-199626, paragraphs 0023 to 0041) may also be applied. The percentage of the polymer latex in the surface protective layer is preferably from 10 to 90 mass %, more preferably from 20 to 80 mass %, based on all binders.

In the surface protective layer (per one layer), the amount of all binders (including water-soluble polymer and latex polymer) coated (per $m^2$ of the support) is preferably from 0.3 to 5.0 $g/m^2$, more preferably from 0.3 to 2.0 $g/m^2$.

In the present invention, the temperature at the preparation of a coating solution for the image-forming layer is preferably from 30 to 65° C., more preferably from 35 to less than 60° C., still more preferably from 35 to 55° C. Furthermore, the coating solution for the image-forming layer immediately after the addition of the polymer latex is preferably kept at a temperature of 30 to 65° C.

In the present invention, the image-forming layer is composed of one or more layer(s) on the support. In the case where the image-forming layer is composed of one layer, the layer comprises an organic silver salt, a photosensitive silver halide, a reducing agent and a binder and if desired, additionally contains desired materials such as color toning agent, coating aid and other adjuvants. In the case where the image-forming layer is composed of two or more layers, a first image-forming layer (usually a layer adjacent to the support) contains an organic silver salt and a photosensitive silver halide, and a second image-forming layer or these two layers contain some other components. A multicolor photosensitive heat-developable photographic material may be constituted to comprise a combination of these two layers for each color or as described in U.S. Pat. No. 4,708,928, contain all components in a single layer. In the case of a multi-dye multicolor photosensitive heat-developable photographic material, the emulsion layers are held separately from each other by interposing a functional or nonfunctional barrier layer between respective photosensitive layers as described in U.S. Pat. No. 4,460,681.

In the present invention, the photosensitive layer may contain various dyes or pigments (for example, C.I. Pigment Blue 60, C.I. Pigment Blue 64, C.I. Pigment Blue 15:6) from the standpoint of improving the color tone, inhibiting the generation of interference fringes at the laser exposure or preventing the irradiation. These are described in detail in WO98/36322, JP-A-10-268465 and JP-A-11-338098.

In the photothermographic material of the present invention, an antihalation layer may be provided in the side farther from a light source with respect to the photosensitive layer.

The photothermographic material generally has a photo-insensitive layer in addition to the photosensitive layer. The photo-insensitive layer can be classified by its position into (1) a protective layer provided on a photosensitive layer (in the side farther from the support), (2) an interlayer provided between a plurality of photosensitive layers or between a photosensitive layer and a protective layer, (3) an undercoat layer provided between a photosensitive layer and a support, and (4) a back layer provided in the side opposite the photosensitive layer. In the photosensitive material, a filter layer is provided as the layer (1) or (2) and an antihalation layer is provided as the layer (3) or (4).

The antihalation layer is described in JP-A-11-65021 (paragraphs 0123 to 0124), JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at the exposure wavelength. In the case where the exposure wavelength is present in the infrared region, an infrared ray-absorbing dye is used and in this case, the dye preferably has no absorption in the visible region.

In the case of preventing the halation by using a dye having absorption in the visible region, substantially no color of the dye preferably remains after the formation of an image. For this purpose, means capable of decolorizing due to heat at the heat development is preferably used. In particular, a photo-insensitive layer is preferably rendered to function as the antihalation layer by adding thereto a thermally decolorizable dye and a base precursor. These techniques are described in JP-A-11-231457.

The amount of the decolorizable dye added is determined according to the use purpose of the dye. In general, the decolorizable dye is used in an amount of giving an optical density (absorbance) in excess of 0.1 when measured at the objective wavelength. The optical density is preferably from 0.15 to 2, more preferably 0.2 to 1. For attaining such an optical density, the amount of the dye used is generally on the order of 0.001 to 1 $g/m^2$.

When such a dye is decolorized, the optical density after heat development can be reduced to 0.1 or less. Two or more decolorizable dyes may be used in combination in the thermally decolorizable recording material or photothermographic material. Also, two or more base precursors may be used in combination.

In the thermal decolorization using these decolorizable dye and base precursor, for example, a substance (e.g., diphenylsulfone, 4-chlorophenyl(phenyl)sulfone) capable of lowering the melting point by 3° C. or more when mixed with a base precursor, described in JP-A-11-352626, or 2-naphthylbenzoate is preferably used in combination in view of the thermal decolorizability and the like.

In the present invention, a coloring agent having an absorption maximum at 300 to 450 nm may be added for the purpose of improving silver tone or change of image in aging. Examples of such a coloring agent include those described in JP-A-62-210458, JP-A-63-104046, JP-A-63-

103235, JP-A-63-208846, JP-A-63-306436, JP-A-63-314535, JP-A-01-61745 and JP-A-2001-100363.

This coloring agent is usually added in the range from 0.1 $mg/m^2$ to 1 $g/m^2$ and the layer to which the coloring agent is added is preferably a back layer provided in the side opposite the photosensitive layer.

In the present invention, the photothermographic material is preferably a so-called one-side photosensitive material having at least one photosensitive layer containing a silver halide emulsion in one side of the support and having a back layer in the other side.

(Description of Matting Agent)

In the present invention, a matting agent is preferably added for improving the conveyance property. Examples of the matting agent include those described in JP-A-11-65021 (paragraphs 0126 to 0127). The amount of the matting agent added is, in terms of the coated amount per $m^2$ of the photosensitive material, preferably from 1 to 400 $mg/m^2$, more preferably from 5 to 300 $mg/m^2$.

The matting agent for use in the present invention may have either a regular form or an amorphous form but preferably has a regular form and is preferably spherical. The average particle size of the matting agent is preferably from 0.5 to 10 μm, more preferably from 1.0 to 8.0 μm, still more preferably from 2.0 to 6.0 μm. The coefficient of variation in the size distribution is preferably 50% or less, more preferably 40% or less, still more preferably 30% or less. The term "coefficient of variation" as used herein means a value represented by (standard deviation of particle size)/(average particle size)×100. It is also preferred to use two matting agents having a small coefficient of variation and different in the average particle size by a ratio of 3 or more.

The matting degree on the emulsion surface may be any value insofar as a stardust failure does not occur but this is preferably, in terms of the Bekk smoothness, from 30 to 2,000 seconds, more preferably from 40 to 1,500 seconds. The Bekk smoothness can be easily determined according to Japanese Industrial Standard (JIS) P8119, "Test Method for Smoothness of Paper and Paperboard by Bekk Tester", and TAPPI Standard Method T479.

In the present invention, the matting degree of the back layer is, in terms of the Bekk smoothness, preferably from 10 to 1,200 seconds, more preferably from 20 to 800 seconds, still more preferably from 40 to 500 seconds.

In the present invention, the matting agent is preferably incorporated into the outermost surface layer, a layer acting as the outermost surface layer, or a layer close to the outer surface, of the photosensitive material and also is preferably incorporated into a layer acting as a protective layer.

The back layer which can be applied to the present invention is described in JP-A-11-65021 (paragraphs 0128 to 0130).

In the photothermographic material of the present invention, the pH on the layer surface before heat development is preferably 7.0 or less, more preferably 6.6 or less. The lower limit thereof is not particularly limited but is about 3. The most preferred pH range is from 4 to 6.2. For adjusting the pH on the layer surface, a nonvolatile acid such as organic acid (e.g., phthalic acid derivative) or sulfuric acid, or a volatile base such as ammonia is preferably used from the standpoint of reducing the pH on the layer surface. In particular, ammonia is preferred for achieving a low layer surface pH, because ammonia is readily volatilized and can be removed in the coating step or before the heat development.

Furthermore, a combination use of ammonia with a nonvolatile base such as sodium hydroxide, potassium hydroxide or lithium hydroxide is also preferred. The method of measuring the pH on the layer surface is described in Japanese Patent Application No. 11-87297 (paragraph 0123).

In the present invention, a hardening agent may be used for each layer such as photosensitive layer, protective layer and back layer. Examples of the hardening agent include those described in T. H. James, *The Theory of the Photographic Process*, Fourth Edition, pp. 77–87, Macmillan Publishing Co., Inc. (1977), such as chrome alum, 2,4-dichloro-6-hydroxy-s-triazine sodium salt, N,N-ethylenebis (vinylsulfonacetamide) and N,N-propylenebis-(vinylsulfonacetamide). In addition, polyvalent metal ions described in *ibid.*, page 78, polyisocyanates described in U.S. Pat. No. 4,281,060 and JP-A-6-208193, epoxy compounds described in U.S. Pat. No. 4,791,042, and vinyl sulfone-base compounds described in JP-A-62-89048 are preferably used.

The hardening agent is added as a solution. The timing of adding this solution to the coating solution for protective layer is from 180 minutes before coating to immediately before coating, preferably from 60 minutes to 10 seconds before coating. The mixing method and mixing conditions are not particularly limited insofar as the effect of the present invention is satisfactorily brought out. Specific examples of the mixing method include a method of mixing the solutions in a tank controlled to give a desired average residence time which is calculated from the addition flow rate and the supply flow rate to the coater, and a method of using a static mixer described, for example, in N. Harnby, M. F. Edwards and A. W. Nienow (translated by Koji Takahashi), *Ekitai Kongou Gijutsu* (*Liquid Mixing Technique*), Chap. 8, Nikkan Kogyo Shinbun Sha (1989).

The surfactant which can be applied to the present invention is described in JP-A-11-65021 (paragraph 0132), the solvent is described in paragraph No. 0133 of the same patent publication, the support is described in paragraph No. 0134 of the same patent publication, the antistatic or electrically conducting layer is described in paragraph No. 0135 of the same patent publication, the method for obtaining a color image is described in paragraph No. 0136 of the same patent publication, and the slipping agent is described in JP-A-11-84573 (paragraphs 0061 to 0064) and Japanese Patent Application No. 11-106881 (paragraphs 0049 to 0062).

In the present invention, the photosensitive material preferably has an electrically conducting layer containing a metal oxide. The electrically conducting material for the electrically conducting layer is preferably a metal oxide increased in the electrical conductivity by introducing an oxygen defect or a dissimilar metal atom into the metal oxide. Preferred examples of the metal oxide include ZnO, $TiO_2$ and $SnO_2$. It is preferred to add Al or In to $ZnO_2$, add Sb, Nb, P or a halogen element to $SnO_2$, and add Nb or Ta to $TiO_2$. In particular, $SnO_2$ having added thereto Sb is preferred. The amount of the dissimilar metal atom added is preferably from 0.01 to 30 mol %, more preferably from 0.1 to 10 mol %. The shape of the metal oxide may be any one of spherical form, needle-like form and plate-like form but in view of the effect of imparting electrical conductivity, a needle-like particle having a long axis/short axis ratio of 2.0 or more, preferably from 3.0 to 50 is preferred. The amount of the metal oxide used is preferably from 1 to 1,000 mg/m$^2$, more preferably from 10 to 500 mg/m$^2$, still more preferably from 20 to 200 mg/m$^2$. In the present invention, the electrically conducting layer may be provided either in the emulsion surface side or in the back surface side but is preferably provided between a support and a back layer. Specific examples of the electrically conducting layer for use in the present invention include those described in JP-A-7-295146 and JP-A-11-223901.

In the present invention, a fluorine-containing surfactant is preferably used. Specific examples of the fluorine-containing surfactant include the compounds described in JP-A-10-197985, JP-A-2000-19680 and JP-A-2000-214554. Also, a polymer fluorine-containing surfactant described in JP-A-9-281636 is preferably used. For use in the photothermographic material of the present invention, fluorine-containing surfactants described in Japanese Patent Application Nos. 2000-206560, 2001-203462, 2001-242357 and 2001-264110 are preferred. Particularly, in the case of using an aqueous coating solution for the coating and production, the fluorine-containing surfactants described in Japanese Patent Application Nos. 2001-242357 and 2001-264110 are preferred in view of capability of adjusting the electric charge, stability of the coated surface state and slipperiness, and the fluorine-containing surfactant described in Japanese Patent Application No. 2001-264110 is most preferred because the capability of adjusting the electric charge is high and the amount used can be small.

In the present invention, the fluorine-containing surfactant can be used either on the emulsion surface or on the back surface and is preferably used on both surfaces. Also, the fluorine-containing surfactant is preferably used in combination with the above-described electrically conducting layer containing a metal oxide. In this case, a sufficiently high performance can be obtained even if the amount of the fluorine-containing surfactant used on the surface having the electrically conducting layer is reduced or the fluorine-containing surfactant is removed.

The amount of the fluorine-containing surfactant used is preferably, on each of the emulsion surface and the back surface, from 0.1 to 100 mg/m$^2$, more preferably from 0.3 to 30 mg/m$^2$, still more preferably from 1 to 10 mg/m$^2$. In particular, the fluorine-containing surfactant described in Japanese Patent Application No. 2001-264110 has a large effect and is preferably used in the range from 0.01 to 10 mg/m$^2$, more preferably from 0.1 to 5 mg/m$^2$.

The transparent support is preferably polyester, particularly polyethylene terephthalate, subjected to a heat treatment at a temperature of 130 to 185° C. so as to relax the internal distortion remaining in the film at the biaxial stretching and thereby eliminate the occurrence of thermal shrinkage distortion during the heat development. In the case of a photothermographic material for medical uses, the transparent support may be colored with a bluish dye (for example, Dye-1 described in Example of JP-A-8-240877) or may not be colored. To the support, a technique of undercoating, for example, a water-soluble polyester described in JP-A-11-84574, a styrene-butadiene copolymer described in JP-A-10-186565, or a vinylidene chloride copolymer described in JP-A-2000-39684 and Japanese Patent Application No. 11-106881 (paragraphs 0063 to 0080) is preferably applied. As for the antistatic layer or undercoating, techniques described in JP-A-56-143430, JP-A-56-143431, JP-A-58-62646, JP-A-56-120519, JP-A-11-84573 (paragraphs 0040 to 0051), U.S. Pat. No. 5,575,957 and JP-A-11-223898 (paragraphs 0078 to 0084) can be applied.

The photothermographic material is preferably a monosheet type (a type where an image can be formed on the photothermographic material without using another sheet such as image-receiving material).

The photothermographic material may further contain an antioxidant, a stabilizer, a plasticizer, an ultraviolet absorbent and a coating aid. These various additives are added to either a photosensitive layer or a photo-insensitive layer. These additives are described in WO98/36322, EP-A-803764, JP-A-10-186567 and JP-A-10-18568.

The photothermographic material of the present invention may be coated by any method. To speak specifically, various coating operations including extrusion coating, slide coating, curtain coating, dip coating, knife coating, flow coating and extrusion coating using a hopper of the type described in U.S. Pat. No. 2,681,294 may be used. The extrusion coating or slide coating described in Stephen F. Kistler and Petert M. Schweizer, *LIQUID FILM COATING*, pp. 399–536, CHAPMAN & HALL (1977) is preferred and the slide coating is more preferred. An example of the shape of the slide coater used in the slide coating is shown in FIG. 11*b*.1 of *ibid.*, page 427. If desired, two or more layers may be simultaneously coated by the methods described in *ibid.*, pp. 399–536, U.S. Pat. No. 2,761,791 and British Patent 837,095.

In the present invention, the coating solution for the organic silver salt-containing layer is preferably a so-called thixotropy fluid. The technique thereon is described in JP-A-11-52509. In the present invention, the coating solution for the organic silver salt-containing layer preferably has a viscosity of 400 to 100,000 mPa·s, more preferably from 500 to 20,000 mPa·s, at a shear rate of 0.1 $S^{-1}$. At a shear rate of 1,000 $S^{-1}$, the viscosity is preferably from 1 to 200 mPa·s, more preferably from 5 to 80 mPa·s.

Examples of the technique which can be used for the photothermographic material of the present invention include those described in EP-A-803764, EP-A-883022, WO98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420 and Japanese Patent Application No. 2000-187298, JP-A-2001-200414 (Japanese Patent Application No. 2000-10229), JP-A-2001-234635 (Japanese Patent Application No. 2000-47345), JP-A-2002-020699 (Japanese Patent Application No. 2000-206642), JP-A-2001-275471 (Japanese Patent Application No. 2000-98530), JP-A-2001-275461 (Japanese Patent Application No. 2000-98531), JP-A-2000-313204 (Japanese Patent Application No. 2000-112059), JP-A-2001-292844 (Japanese Patent Application No. 2000-112060), JP-A-2000-324888 (Japanese Patent Application No. 2000-112104), JP-A-2001-293864 (Japanese Patent Application No. 2000-112064) and JP-A-2001-348546 (Japanese Patent Application No. 2000-171936).

(Description of Packaging Material)

The photosensitive material of the present invention is preferably packaged by a packaging material having a low oxygen permeability and/or a low moisture permeability so as to prevent the photographic performance from fluctuating during the stock storage or improve the curling or rolling habit. The oxygen permeability at 25° C. is preferably 50 mL/atm·m$^2$·day or less, more preferably 10 mL/atm·m$^2$·day or less, still more preferably 1.0 mL/atm·m$^2$·day or less. The moisture permeability is preferably 10 g/atm·m$^2$·day or less, more preferably 5 g/atm·m$^2$·day or less, still more preferably 1 g/atm·m$^2$·day or less.

Specific examples of the packaging material having a low oxygen permeability and/or a low moisture permeability include the packaging materials described in JP-A-8-254793 and JP-A-2000-206653.

(Description of Heat Development)

The photothermographic material of the present invention may be developed by any method but the imagewise exposed photothermographic material is usually developed by elevating the temperature. The developing temperature is preferably from 80 to 250° C., more preferably from 100 to 140° C., still more preferably from 110 to 130° C. The developing time is preferably from 1 to 60 seconds, more preferably from 3 to 30 seconds, still more preferably from 5 to 25 seconds, particularly preferably from 7 to 15 seconds.

The heat development may be performed by using either a drum-type heater or a plate-type heater but a plate heater system is more preferred. The heat development in a plate heater system is preferably performed by the system described in JP-A-11-133572, which is a heat development apparatus of obtaining a visible image by bringing a photothermographic material having formed therein a latent image into contact with a heating device in the heat development section, wherein the heating device comprises a plate heater and a plurality of press rollers are disposed along one surface of the plate heater to face each other and wherein the photothermographic material is passed between the press rollers and the plate heater to perform the heat development. It is preferred to divide the plate heater into 2 to 6 stages and decrease the temperature at the leading end part by approximately from 1 to 10° C. For example, four pairs of plate heaters capable of independently controlling the temperature are used and controlled to 112° C., 119° C., 121° C. and 120° C., respectively. This method is described also in JP-A-54-30032. According to this method, moisture and organic solvents contained in the photothermographic material can be removed out of the system and the support of the photothermographic material can be suppressed from deformation due to abrupt heating of the heat-developable photosensitive material.

The photosensitive material of the present invention may be exposed by any method but a laser ray is preferably used as the light source for exposure. Preferred examples of the laser ray for use in the present invention include a gas laser (e.g., $Ar^+$, He—Ne), a YAG laser, a dye laser and a semiconductor laser. A semiconductor laser and a second harmonic generating element may also be used. A gas or semiconductor laser of emitting red to infrared light is preferred, and a semiconductor laser of emitting blue to violet light is more preferred. Examples of the high output semiconductor laser of emitting blue to violet light include a semiconductor laser NLHV3000E manufactured by Nichia Corporation. A laser ray at an output of 35 mW and a wavelength of 405 nm is disclosed. By using such a laser ray, high brightness light at 390 to 430 nm which are a wavelength particularly preferred in the present invention can be obtained.

Fuji Medical Dry Laser Imager FM-DP L is a laser imager having an exposure section and a heat development section for medical uses. The Fuji Medical Dry Laser Imager FM-DP L is described in *Fuji Medical Review*, No. 8, pages 39 to 55. The techniques described therein can be of course applied to the laser imager used for the photothermographic material of the present invention. The photothermographic material of the present invention can also be used as a photothermographic material for a laser imager in "AD network" proposed by Fuji Medical System as a network system adapted to the DICOM Standard.

The photothermographic material of the present invention forms a black-and-white image based on a silver image and is preferably used as a photothermographic material for medical diagnosis, a photothermographic material for industrial photography, a photothermographic material for printing or a photothermographic material for COM.

EXAMPLES

The present invention is described in greater detail below by referring to Examples, however, the present invention is not limited thereto.

<Preparation of Silver Halide Emulsion 1A>

To Solution A prepared by adding 30 g of phthalated gelatin and 0.02 g of potassium iodide to 1,200 ml of distilled water, an aqueous solution containing 0.014 mol of silver nitrate and Aqueous Solution B containing 0.0147 mol of potassium iodide were simultaneously added and mixed at 75° C. with stirring. Subsequently, an aqueous solution containing 0.794 mol of silver nitrate was added at a constant flow rate at 75° C. with stirring and at the same time, Aqueous Solution C containing 1.1 mol/L of potassium iodide was added by a controlled double jet method while maintaining the pAg at 6.5. After adjusting the pH to 4.0 by using sulfuric acid in a concentration of 0.5 mol/L, the stirring was stopped and precipitation/desalting/water washing were performed. Subsequently, the pH was adjusted to 5.9 by using sodium hydroxide in a concentration of 1 mol/L to prepare Silver Halide Emulsion 1A. In the obtained silver halide emulsion, the average equivalent-sphere diameter of particles was 0.16 μm and the coefficient of variation in the equivalent-sphere diameter was 20%.

<Preparation of Silver Halide Emulsions 1B to 1G>

Silver Halide Emulsions 1B to 1G were prepared by changing, in the preparation of Silver Halide Emulsion 1A, the temperature at the addition of Aqueous Solution B and the temperature and pAg at the addition of Aqueous Solution C as shown in Table 1. The average equivalent-sphere diameter of grains and coefficient of variation in the equivalent-sphere diameter of each silver halide emulsion obtained are shown together in Table 1.

TABLE 1

| Name of Emulsion | Temperature at Addition of Aqueous Solution B | Temperature at Addition of Aqueous Solution C | pAg at Addition of Aqueous Solution C | Average Equivalent-Sphere Diameter | Coefficient of Variation |
|---|---|---|---|---|---|
| 1A (Comparison) | 75° C. | 75° C. | 6.5 | 0.16 μm | 20% |
| 1B (Invention) | 75° C. | 60° C. | 7.0 | 0.15 μm | 18% |
| 1C (Invention) | 75° C. | 45° C. | 7.5 | 0.15 μm | 16% |
| 1D (Comparison) | 55° C. | 75° C. | 6.5 | 0.16 μm | 19% |
| 1E (Invention) | 55° C. | 60° C. | 7.0 | 0.14 μm | 14% |
| 1F (Comparison) | 55° C. | 60° C. | 6.1 | 0.16 μm | 22% |
| 1G (Invention) | 55° C. | 60° C. | 8.7 | 0.12 μm | 10% |

Gelatin was undercoated on a PET base having a thickness of 150 μm and thereon, Emulsions 1A to 1G prepared above each was coated to have a coated silver amount of 1.5 g/m$^2$, thereby preparing Samples 1 to 7. These samples were subjected to the measurement of crystallite size and the sensitometry evaluation described below. The comparison value (R/r) determined from the crystallite size (r) obtained in the measurement of crystallite size and the average grain size (R) and the results of sensitometry are shown in Table 2. It is apparent from Table 2 that as the comparison value (R/r) is closer to 1, the internal sensitivity is lower and the surface sensitivity is higher. This reveals that by the high silver iodide emulsion according to the present invention, a high-sensitivity photographic emulsion can be obtained.

(Sensitometry Evaluation)

In a high brightness exposure meter manufactured by Yamashita Denso Corporation, the sample was subjected to gradation exposure using a wedge through a band pass filter having a transmission maximum at 380 nm with an exposure brightness of 1/1000 seconds. The exposed sample was then subjected to a surface development treatment and an internal development treatment with respective processing solutions shown below. Thereafter, the density was measured and the sensitometry was evaluated by taking, as the sensitivity, the reciprocal of exposure amount of giving a density of 0.5 in terms of the black optical density in addition to fog. The sensitivity is shown by a relative sensitivity to the sensitivity of Sample 1 which is regarded as 100.

(Surface Development)

The development was performed over 60 minutes with Processing Solution A shown below which was kept at 38° C. After the completion of development, the sample was fixed and washed with water. The film was dried and then measured on the density.

(Preparation of Processing Solution A)

Chemicals Added:

| | |
|---|---|
| Sodium bisulfite | 5 g |
| Pyrogallol | 10 g |
| Sodium sulfite (SS) | 25 g |
| Sodium carbonate monohydrate (SC) | 50 g |
| KI | 0.1 g |
| 10% Formalin (containing 4% of formaldehyde) | 25.0 ml |

-continued

| | |
|---|---|
| Water to make | 1 liter (pH: 10.1) |

(Internal Development)

The sample was processed by dipping it in Processing Solution B kept at 20° C. for 10 minutes, then washed with water and developed over 60 minutes with Processing Solution C kept at 38° C. After the completion of development, the sample was fixed and washed with water. The resulting film was dried and then measured on the density.

(Preparation of Processing Solution B)

Chemicals Added:

| | |
|---|---|
| Phenosafranine | 0.0125 g |
| Red prussiate | 3 g |
| Water to make | 1 liter |

(Preparation of Processing Solution C)

Chemicals Added:

| | |
|---|---|
| Sodium bisulfite | 5 g |
| Pyrogallol | 10 g |
| Sodium sulfite (SS) | 25 g |
| Sodium carbonate monohydrate (SC) | 50 g |
| KI | 0.1 g |
| 10% Formalin solution (containing 4% of formaldehyde) | 25.0 ml |
| Sodium thiosulfate pentahydrate | 3 g |
| Water to make | 1 liter |

TABLE 2

| Sample | Name of Emulsion | Crystallite Size | R/r | Internal Sensitivity | Surface Sensitivity |
|---|---|---|---|---|---|
| 1 | 1A (Comparison) | 0.043 μm | 3.7 | 100 | 100 |
| 2 | 1B (Invention) | 0.079 μm | 1.9 | 87 | 126 |
| 3 | 1C (Invention) | 0.088 μm | 1.7 | 83 | 135 |
| 4 | 1D (Comparison) | 0.050 μm | 3.2 | 97 | 104 |
| 5 | 1E (Invention) | 0.108 μm | 1.3 | 74 | 150 |
| 6 | 1F (Comparison) | 0.070 μm | 2.3 | 92 | 110 |
| 7 | 1G (invention) | 0.109 μm | 1.1 | 70 | 165 |

Example 2

(Preparation of PET Support)

PET having an intrinsic viscosity IV of 0.66 (measured at 25° C. in phenol/tetrachloroethane=6/4 (by mass)) was obtained in a usual manner by using terephthalic acid and ethylene glycol. This PET was pelletized and the pellets obtained were dried at 130° C. for 4 hours, melted at 300° C., extruded from a T-die and then rapidly cooled to prepare an unstretched film having a thickness large enough to give a film thickness of 175 μm after the heat setting.

This film was stretched to 3.3 times in the machine direction by using rollers different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edges of the film were knurled, and the film was taken up at 4 kg/cm$^2$ to obtain a roll having a thickness of 175 μm.

(Surface Corona Treatment)

Both surfaces of the support were treated at room temperature at 20 m/min by using a solid state corona treating machine Model 6KVA manufactured by Pillar Technologies. From the current and voltage read at this time, it was known that a treatment of 0.375 kV·A·min/m$^2$ was applied to the support. The frequency at this treatment was 9.6 kHz and the gap clearance between the electrode and the dielectric roller was 1.6 mm.

(Preparation of Undercoated Support)

(1) Preparation of Coating Solution for Undercoat Layer Formulation (1) (for undercoat layer in the photosensitive layer side):

| | |
|---|---|
| PESRESIN A-520 (30 mass % solution) produced by Takamatsu Oil & Fat Co., Ltd. | 59 g |
| Polyethylene glycol monononylphenyl ether (average ethylene oxide number: 8.5), 10 mass % solution | 5.4 g |
| MP-1000 (polymer particles, average particle size: 0.4 μm) produced by The Soken Chemical & Engineering Co., Ltd. | 0.91 g |
| Distilled water | 935 ml |

Formulation (2) (for first layer on the back surface):

| | |
|---|---|
| Styrene-butadiene copolymer latex (solid content: 40 mass %, styrene/butadiene ratio = 68/32 by mass) | 158 g |
| 2,4-Dichloro-6-hydroxy-S-triazine sodium salt, 8 mass % aqueous solution | 20 g |
| Sodium laurylbenzenesulfonate (1 mass % aqueous solution) | 10 ml |
| Distilled water | 854 ml |

Formulation (3) (for second layer on the back surface):

| | |
|---|---|
| $SnO_2$/SbO (9/1 by mass, average particle size: 0.038 μm, 17 mass % dispersion) | 84 g |
| Gelatin (10 mass % aqueous solution) | 89.2 g |
| METROSE TC-5 produced by Shin-Etsu Chemical Co., Ltd. (2 mass % aqueous solution) | 8.6 g |
| MP-1000 produced by The Soken Chemical & Engineering Co., Ltd. | 0.01 g |
| Sodium dodecylbenzenesulfonate (1 mass % aqueous solution) | 10 ml |
| NaOH (1 mass %) | 6 ml |
| PROXEL (produced by ICI) | 1 ml |
| Distilled water | 805 ml |

Both surfaces of the 175 μm-thick biaxially stretched polyethylene terephthalate support obtained above were subjected to the above-described corona discharge treatment and on one surface (photosensitive layer surface), the undercoating solution of formulation (1) was applied by a wire bar to have a wet coated amount of 6.6 ml/m$^2$ (per one surface) and dried at 180° C. for 5 minutes. Thereafter, on the opposite surface thereof (back surface), the undercoating solution of formulation (2) was applied by a wire bar to have a wet coated amount of 5.7 ml/m$^2$ and dried at 180° C. for 5 minutes. On this opposite surface (back surface), the undercoating solution of formulation (3) was further applied by a wire bar to have a wet coated amount of 7.7 ml/m$^2$ and dried at 180° C. for 6 minutes, thereby obtaining an undercoated support.

(Preparation of Coating Solution for Back Surface)

(Preparation of Solid Fine Particle Dispersion (a) of Base Precursor)

Base Precursor Compound 1 (1.5 kg), 225 g of surfactant (Demol N, trade name, produced by Kao Corporation), 937.5 g of diphenylsulfone and 15 g of butyl parahydroxybenzoate (Mekkins, trade name, produced by Ueno Seiyaku) were mixed and distilled water was added to make a total amount of 5.0 kg. The mixed solution was dispersed using beads in a horizontal sand mill (UVM-2, manufactured by IMEX Co., Ltd.). More specifically, the mixed solution was fed to UVM-2 filled with zirconia beads having an average diameter of 0.5 mm by a diaphragm pump and dispersed under an internal pressure of 50 hPa or more until a desired average particle size was obtained.

By measuring the spectral absorption, the dispersion was dispersed until the ratio (D450/D650) of the absorbance at 450 nm to the absorbance at 650 nm in the spectral absorption of the dispersion became 2.2 or more. The obtained dispersion was diluted with distilled water to a concentration of 20 mass % in terms of the concentration of the base precursor, filtered (through a polypropylene-made filter having an average pore size of 3 μm) to remove dusts and then used in practice.

(Preparation of Solid Fine Particle Dispersion of Dye)

Cyanine Dye Compound 1 (6.0 kg), 3.0 kg of sodium p-dodecylbenzenesulfonate, 0.6 kg of a surfactant Demol SNB (produced by Kao Corporation) and 0.15 kg of a defoaming agent (Surfynol 104E, trade name, produced by Nissin Chemical Industry Co., Ltd.) were mixed with distilled water to make a total liquid amount of 60 kg. The mixed solution was dispersed using zirconia beads of 0.5 mm in a horizontal sand mill (UVM-2, manufactured by IMEX Co., Ltd.).

By measuring the spectral absorption, the dispersion was dispersed until the ratio (D650/D750) of the absorbance at 650 nm to the absorbance at 750 nm in the spectral absorption of the dispersion became 5.0 or more. The obtained dispersion was diluted with distilled water to a concentration of 6 mass % in terms of the concentration of the cyanine dye, filtered (average pore size: 1 μm) to remove dusts and then used in practice.

(Preparation of Coating Solution for Antihalation Layer)

Gelatin (30 g), 24.5 g of polyacrylamide, 2.2 g of 1 mol/liter caustic soda, 2.4 g of monodisperse polymethyl methacrylate fine particles (average particle size: 8 μm, standard deviation of particle size: 0.4), 0.08 g of benzoisothiazolinone, 35.9 g of the solid fine particle dispersion of dye obtained above, 74.2 g of Solid Fine Particle Dispersion (a) of base precursor obtained above, 0.6 g of sodium polyethylenesulfonate, 0.21 g of Blue Dye Compound 1, 0.15 g of Yellow Dye Compound 1 and 8.3 g of an acrylic acid/ethyl acrylate copolymer latex (copolymerization ratio: 5/95) were mixed and water was added to make a total amount of 8,183 ml, thereby preparing a coating solution for antihalation layer.

(Preparation of Coating Solution for Protective Layer on Back Surface)

In a container kept at 40° C., 40 g of gelatin, 1.5 g (as liquid paraffin) of liquid paraffin emulsion, 35 mg of benzoisothiazolinone, 6.8 g of 1 mol/liter caustic soda, 0.5 g of sodium tert-octylphenoxyethoxyethanesulfonate, 0.27 g of sodium polystyrenesulfonate, 37 mg of Fluorine-Containing Surfactant (F-1) (N-perfluorooctylsulfonyl-N-propylalanine potassium salt), 150 m g of Fluorine-Containing Surfactant (F-2) (polyethylene glycol mono(N-perfluorooctylsulfonyl-N-propyl-2-aminoethyl) ether [ethylene oxide average polymerization degree: 15]), 64 mg of Fluorine-Containing Surfactant (F-3), 32 mg of Fluorine-Containing Surfactant (F-4), 6.0 g of an acrylic acid/ethyl acrylate copolymer (copolymerization ratio: 5/95 by mass) and 2.0 g of N,N-ethylenebis(vinylsulfonacetamide) were mixed and water was added to make 10 liter, thereby preparing a coating solution for protective layer on the back surface.

(Preparation of Silver Halide Emulsion)

<Preparation of Silver Halide Emulsion 2A>

Silver Halide Emulsion 2A was prepared in the same manner as in the preparation of Silver Halide Emulsion 1A except that the temperature at the addition of Aqueous Solution B was changed to 55° C. and Aqueous Solution B and Aqueous Solution C were rapidly added. In the obtained silver halide emulsion, the average equivalent-sphere diameter of grains was 0.06 μm and the coefficient of variation in the equivalent-sphere diameter was 30%.

<Preparation of Silver Halide Emulsions 2B and 2C>

Silver Halide Emulsions 2B and 2C were prepared by changing, in the preparation of Silver Halide Emulsion 2A, the temperature at the addition of Aqueous Solution B and the temperature and pAg at the addition of Aqueous Solution C as shown in Table 3. The average equivalent-sphere diameter of grains, coefficient of variation in the equivalent-sphere diameter, and the comparison value (R/r) of the average grain size (R) and the crystallite size (r) of each silver halide emulsion obtained are shown together.

TABLE 3

| Name of Emulsion | Temperature at Addition of Aqueous Solution B | Temperature at Addition of Aqueous Solution C | pAg at Addition of Aqueous Solution C | Average Equivalent-Sphere Diameter | Coefficient of Variation | |
|---|---|---|---|---|---|---|
| 2A (Comparison) | 55° C. | 75° C. | 6.5 | 0.06 μm | 30% | 2.1 |
| 2B (Invention) | 55° C. | 60° C. | 7.0 | 0.06 μm | 18% | 1.6 |
| 2C (Invention) | 55° C. | 60° C. | 8.7 | 0.06 μm | 16% | 1.2 |

<Preparation of Emulsion 2A for Coating Solution>

Using Silver Halide Emulsion 2A, Chemical Sensitizer 1 was added thereto at 40° C. in an amount of $1\times10^{-3}$ mol per mol of silver halide and thoroughly mixed. Thereafter, a 1 mass % aqueous solution of benzothiazolium iodide was added in an amount of $7\times10^{-3}$ mol per mol of silver. Furthermore, water was added to give a silver halide content of 38.2 g as silver per 1 kg of the emulsion for coating solution, thereby preparing Emulsion 2A for Coating Solution.

<Preparation of Emulsion 2B for Coating Solution>

Emulsion 2B for Coating Solution was prepared in the same manner as Emulsion 2A for Coating Solution except that Silver Halide Emulsion 2A was changed to Silver Halide Emulsion 2B.

<Preparation of Emulsion 2C for Coating Solution>

Emulsion 2C for Coating Solution was prepared in the same manner as Emulsion 2A for Coating Solution except that Silver Halide Emulsion 2A was changed to Silver Halide Emulsion 2C.

<Preparation of Fatty Acid Silver Salt Dispersion A>

Behenic acid (Edenor C22-85R, product name, produced by Henkel Co.) (87.6 kg), 423 liter of distilled water, 49.2 liter of an aqueous NaOH solution in a concentration of 5 mol/liter, and 120 liter of tert-butyl alcohol were mixed. The mixture was reacted with stirring at 75° C. for one hour to obtain Sodium Behenate Solution A. Separately, 206.2 liter (pH 4.0) of an aqueous solution containing 40.4 kg of silver nitrate was prepared and kept at 10° C. A reaction vessel containing 635 liter of distilled water and 30 liter of tert-butyl alcohol was kept at 30° C. and while thoroughly stirring, the entire amount of Sodium Behenate Solution A obtained above and the entire amount of the aqueous silver nitrate solution prepared above were added at a constant flow rate over 93 minutes and 15 seconds and over 90 minutes, respectively. At this time, only the aqueous silver nitrate solution was added for the period of 11 minutes after the initiation of addition of the aqueous silver nitrate solution, then addition of Sodium Behenate Solution A was started, and only Sodium Behenate Solution A was added for the period of 14 minutes and 15 second after the completion of addition of the aqueous silver nitrate solution. During the addition, the temperature inside the reaction vessel was kept at 30° C. and the external temperature was controlled to make constant the liquid temperature. The piping in the system of adding Sodium Behenate Solution A was kept warm by circulating hot water in the outer side of a double pipe and thereby the outlet liquid temperature at the distal end of the addition nozzle was adjusted to 75° C. The piping in the system of adding the aqueous silver nitrate solution was kept warm by circulating cold water in the outer side of a double pipe. The addition site of Sodium Behenate Solution A and the addition site of the aqueous silver nitrate solution were symmetrically arranged by laying the center on the stirring axis. Also, these addition sites were each adjusted to a height of not contacting with the reaction solution.

After the completion of addition of Sodium Behenate Solution A, the mixture was left standing at the same temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was evaluated by electron microphotography, as a result, the grains were scaly crystals having average sizes of a=0.14 μm, b=0.4 μm and c=0.6 μm, an average aspect ratio of 5.2, an average equivalent-sphere diameter of 0.52 μm and a coefficient of variation in the equivalent-sphere diameter of 15% (a, b and c comply with the definition in the specification).

To the wet cake corresponding to 260 kg as a dry solid content, 19.3 kg of polyvinyl alcohol (PVA-217, trade name) and water were added to make a total amount of 1,000 kg. The resulting mixture was formed into a slurry by a dissolver blade and the slurry was preliminarily dispersed by a pipeline mixer (Model PM-10, manufactured by Mizuho Kogyo).

Then, the preliminarily dispersed stock solution was treated three times in a dispersing machine (Microfluidizer M-610, trade name, manufactured by Microfluidex International Corporation, using a Z-type interaction chamber) under the control of pressure to 1,260 kg/cm$^2$ to obtain a silver behenate dispersion. At the dispersion, the temperature was set to 18° C. by a cooling operation of controlling the coolant temperature by using coiled heat exchangers attached to the inlet side and outlet side of the interaction chamber.

<Preparation of Fatty Acid Silver Salt Dispersion B>

<Preparation of Recrystallized Behenic Acid>

Behenic acid (Edenor C22-85R, product name, produced by Henkel Co.) (100 kg) was mixed with 1,200 kg of isopropyl alcohol and the mixture was dissolved at 50° C. and filtered through a filter of 10 μm. Thereafter, the filtrate was cooled to 30° C. and recrystallized. At the recrystallization, the cooling speed was controlled to 3° C./hour. The obtained crystals were filtered by centrifugation, washed by splashing 100 kg of isopropyl alcohol thereon and then dried. The resulting crystals were esterified and analyzed by GC-FID, as a result, the silver behenate content was 96% and other than this, 2% of lignoceric acid and 2% of arachidinic acid were contained.

<Preparation of Fatty Acid Silver Salt Dispersion B>

The recrystallized behenic acid (88 kg), 422 liter of distilled water, 49.2 liter of an aqueous NaOH solution in a concentration of 5 mol/liter, and 120 liter of tert-butyl alcohol were mixed. The mixture was reacted with stirring at 75° C. for one hour to obtain Sodium Behenate Solution B. Separately, 206.2 liter (pH 4.0) of an aqueous solution containing 40.4 kg of silver nitrate was prepared and kept at 10° C. A reaction vessel containing 635 liter of distilled water and 30 liter of tert-butyl alcohol was kept at 30° C. and while thoroughly stirring, the entire amount of Sodium Behenate Solution B obtained above and the entire amount of the aqueous silver nitrate solution prepared above were added at a constant flow rate over 93 minutes and 15 seconds and over 90 minutes, respectively. At this time, only the aqueous silver nitrate solution was added for the period of 11 minutes after the initiation of addition of the aqueous silver nitrate solution, then addition of Sodium Behenate Solution B was started, and only Sodium Behenate Solution B was added for the period of 14 minutes and 15 second after the completion of addition of the aqueous silver nitrate solution. During the addition, the temperature inside the reaction vessel was kept at 30° C. and the external temperature was controlled to make constant the liquid temperature. The piping in the system of adding Sodium Behenate Solution B was kept warm by circulating hot water in the outer side of a double pipe and thereby the outlet liquid temperature at the distal end of the addition nozzle was adjusted to 75° C. The piping in the system of adding the aqueous silver nitrate solution was kept warm by circulating cold water in the outer side of a double pipe. The addition site of Sodium Behenate Solution B and the addition site of aqueous silver nitrate solution were symmetrically arranged by laying the center on the stirring axis. Also, these addition sites were each adjusted to a height of not contacting with the reaction solution.

After the completion of addition of Sodium Behenate Solution B, the mixture was left standing at the same temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was evaluated by electron microphotography, as a result, the grains were scaly crystals having average sizes of a=0.21 μm, b=0.4 μm and c=0.4 μm, an average aspect ratio of 2.1, an average equivalent-sphere diameter of 0.51 μm and a coefficient of variation in the equivalent-sphere diameter of 11% (a, b and c comply with the definition in the specification).

To the wet cake corresponding to 260 kg as a dry solid content, 19.3 kg of polyvinyl alcohol (PVA-217, trade name) and water were added to make a total amount of 1,000 kg. The resulting mixture was formed into a slurry by a dissolver blade and the slurry was preliminarily dispersed by a pipeline mixer (Model PM-10, manufactured by Mizuho Kogyo).

Then, the preliminarily dispersed stock solution was treated three times in a dispersing machine (Microfluidizer M-610, trade name, manufactured by Microfluidex International Corporation, using a Z-type interaction chamber) under the control of pressure to 1,150 kg/cm$^2$ to obtain a silver behenate dispersion. At the dispersion, the temperature was set to 18° C. by a cooling operation of controlling the coolant temperature by using coiled heat exchangers attached to the inlet side and outlet side of the interaction chamber.

(Preparation of Reducing Agent Dispersion)

<Preparation of Reducing Agent Complex 1 Dispersion>

Water (10 kg) was added to 10 kg of Reducing Agent Complex 1 (a 1:1 complex of 6,6'-di-tert-butyl-4,4'-dimethyl-2,2'-butylidenediphenol and triphenylphosphine oxide), 0.12 kg of triphenylphosphine oxide and 16 kg of a 10 mass % aqueous solution of modified polyvinyl alcohol (Poval MP203, produced by Kuraray Co., Ltd.) and thoroughly mixed to form a slurry. This slurry was transferred by a diaphragm pump to a horizontal sand mill (UVM-2, manufactured by IMEX Co., Ltd.) filled with zirconia beads having an average diameter of 0.5 mm, and dispersed for 4 hours and 30 minutes. Thereafter, 0.2 g of benzoisothiazolinone sodium salt and water were added to adjust the reducing agent complex concentration to 22 mass %, thereby obtaining Reducing Agent Complex 1 Dispersion. The reducing agent complex particles contained in the thus-obtained reducing agent complex dispersion had a median diameter of 0.45 μm and a maximum particle size of 1.4 μm or less. The obtained reducing agent complex dispersion was filtered through a polypropylene-made filter having a pore size of 3.0 μm to remove foreign matters such as dust and then housed.

<Preparation of Reducing Agent 2 Dispersion>

Water (10 kg) was added to 10 kg of Reducing Agent 2 (6,6'-di-tert-butyl-4,4'-dimethyl-2,2'-butylidenediphenol) and 16 kg of a 10 mass % aqueous solution of modified polyvinyl alcohol (Poval MP203, produced by Kuraray Co., Ltd.) and thoroughly mixed to form a slurry. This slurry was transferred by a diaphragm pump to a horizontal sand mill (UVM-2, manufactured by IMEX Co., Ltd.) filled with zirconia beads having an average diameter of 0.5 mm, and dispersed for 3 hours and 30 minutes. Thereafter, 0.2 g of benzoisothiazolinone sodium salt and water were added to adjust the reducing agent concentration to 25 mass %. This dispersion solution was heat-treated at 60° C. for 5 hours to obtain Reducing Agent 2 Dispersion. The reducing agent particles contained in the thus-obtained reducing agent dispersion had a median diameter of 0.40 μm and a maximum particle size of 1.5 μm or less. The obtained reducing agent dispersion was filtered through a polypropylene-made filter having a pore size of 3.0 μm to remove foreign matters such as dust and then housed.

<Preparation of Hydrogen-Bonding Compound 1 Dispersion>

Water (10 kg) was added to 10 kg of Hydrogen-Bonding Compound 1 (tri(4-tert-butylphenyl)phosphine oxide) and 16 kg of a 10 mass % aqueous solution of modified polyvinyl alcohol (Poval MP203, produced by Kuraray Co., Ltd.) and thoroughly mixed to form a slurry. The resulting slurry was transferred by a diaphragm pump to a horizontal sand mill (UVM-2, manufactured by IMEX Co., Ltd.) filled with zirconia beads having an average diameter of 0.5 mm, and dispersed for 3 hours and 30 minutes. Thereafter, 0.2 g of benzoisothiazolinone sodium salt and water were added to adjust the hydrogen-bonding compound concentration to 25 mass %. This dispersion solution was heated at 80° C. for one hour to obtain Hydrogen-Bonding Compound 1 Dispersion. The hydrogen-bonding compound particles contained in the thus-obtained hydrogen-bonding compound dispersion had a median diameter of 0.35 μm and a maximum particle size of 1.5 μm or less. The obtained hydrogen-bonding compound dispersion was filtered through a polypropylene-made filter having a pore size of 3.0 μm to remove foreign matters such as dust and then housed.

<Preparation of Development Accelerator 1 Dispersion>

Water (10 kg) was added to 10 kg of Development Accelerator 1 and 20 kg of a 10 mass % aqueous solution of modified polyvinyl alcohol (Poval MP203, produced by Kuraray Co., Ltd.) and thoroughly mixed to form a slurry. The resulting slurry was transferred by a diaphragm pump to a horizontal sand mill (UVM-2, manufactured by IMEX Co., Ltd.) filled with zirconia beads having an average diameter of 0.5 mm, and dispersed for 3 hours and 30 minutes. Thereafter, 0.2 g of benzoisothiazolinone sodium salt and water were added to adjust the development accelerator concentration to 20 mass %, thereby obtaining Development Accelerator 1 Dispersion. The development accelerator particles contained in the thus-obtained development accelerator dispersion had a median diameter of 0.48 μm and a maximum particle size of 1.4 μm or less. The obtained development accelerator dispersion was filtered through a polypropylene-made filter having a pore size of 3.0 μm to remove foreign matters such as dust and then housed.

Solid Dispersions of Development Accelerator 2, Development Accelerator 3 and Color Tone Adjusting Agent 1 each was obtained as a 20 mass % dispersion in the same manner as Development Accelerator 1.

(Preparation of Polyhalogen Compound)

<Preparation of Organic Polyhalogen Compound 1 Dispersion>

Water (14 kg) was added 10 kg of Organic Polyhalogen Compound 1 (tribromomethanesulfonylbenzene), 10 kg of a 20 mass % aqueous solution of modified polyvinyl alcohol (Poval MP203, produced by Kuraray Co., Ltd.) and 0.4 kg of a 20 mass % aqueous solution of sodium triisopropylnaphthalenesulfonate and thoroughly mixed to form a slurry. The resulting slurry was transferred by a diaphragm pump to a horizontal sand mill (UVM-2, manufactured by IMEX Co., Ltd.) filled with zirconia beads having an average diameter of 0.5 mm, and dispersed for 5 hours. Thereafter, 0.2 g of benzoisothiazolinone sodium salt and water were added to adjust the organic polyhalogen compound concentration to 26 mass %, thereby obtaining Organic Polyhalogen Compound 1 Dispersion. The organic polyhalogen compound particles contained in the thus-obtained polyhalogen compound dispersion had a median diameter of 0.41 μm and a maximum particle size of 2.0 μm or less. The obtained organic polyhalogen compound dispersion was filtered through a polypropylene-made filter having a pore size of 10.0 μm to remove foreign matters such as dust and then housed.

<Preparation of Organic Polyhalogen Compound 2 Dispersion>

Organic Polyhalogen Compound 2 (N-butyl-3-tribromomethanesulfonylbenzamide) (10 kg), 20 kg of a 10 mass % aqueous solution of modified polyvinyl alcohol (Poval MP203, produced by Kuraray Co., Ltd.) and 0.4 kg of a 20 mass % aqueous solution of sodium triisopropylnaphthalenesulfonate were added and thoroughly mixed to form a slurry. The resulting slurry was transferred by a diaphragm pump to a horizontal sand mill (UVM-2, manufactured by IMEX Co., Ltd.) filled with zirconia beads having an average diameter of 0.5 mm, and dispersed for 5 hours. Thereafter, 0.2 g of benzoisothiazolinone sodium salt and water were added to adjust the organic polyhalogen compound concentration to 30 mass %. This dispersion solution was heated at 40° C. for 5 hours to obtain Organic Polyhalogen Compound 2 Dispersion. The organic polyhalogen compound particles contained in the thus-obtained polyhalogen compound dispersion had a median diameter of 0.40 μm and a maximum particle size of 1.3 μm or less. The obtained organic polyhalogen compound dispersion was filtered through a polypropylene-made filter having a pore size of 3.0 μm to remove foreign matters such as dust and then housed.

<Preparation of Phthalazine Compound 1 Solution>

In 174.57 kg of water, 8 kg of modified polyvinyl alcohol MP203 produced by Kuraray Co., Ltd. was dissolved. Thereto, 3.15 kg of a 20 mass % aqueous solution of sodium triisopropylnaphthalenesulfonate and 14.28 kg of a 70 mass % aqueous solution of Phthalazine Compound 1 (6-isopropylphthalazine) were added to prepare a 5 mass % solution of Phthalazine Compound 1.

(Preparation of Mercapto Compound)

<Preparation of Aqueous Mercapto Compound 1 Solution>

In 993 g of water, 7 g of Mercapto Compound 1 (1-(3-sulfophenyl)-5-mercaptotetrazole sodium salt) was dissolved to prepare a 0.7 mass % aqueous solution.

<Preparation of Aqueous Mercapto Compound 2 Solution>

In 980 g of water, 20 g of Mercapto Compound 2 (1-(3-methylureido)-5-mercaptotetrazole sodium salt) was dissolved to prepare a 2.0 mass % aqueous solution.

<Preparation of Pigment 1 Dispersion>

Water (250 g) was added to 64 g of C.I. Pigment Blue 60 and 6.4 g of Demol N (produced by Kao Corporation) and thoroughly mixed to form a slurry. The resulting slurry and 800 g of zirconia beads having an average diameter of 0.5 mm were put together into a vessel and dispersed for 25 hours in a dispersing machine (1/4G Sand Grinder Mill, manufactured by IMEX Co., Ltd.) to obtain Pigment 1 Dispersion. The pigment particles contained in the thus-obtained pigment dispersion had an average particle size of 0.21 μm.

<Preparation of SBR Latex Solution>

An SBR latex having a Tg of 22° C. was prepared as follows.

Using ammonium persulfate as a polymerization initiator and an anionic surfactant as an emulsifier, 70.0 mass of styrene, 27.0 mass of butadiene and 3.0 mass of acrylic acid were emulsion-polymerized. After aging at 80° C. for 8 hours, the resulting polymer was cooled to 40° C. and adjusted to a pH of 7.0 with aqueous ammonia. Thereto, SANDET BL (produced by Sanyo Chemical Industries Co., Ltd.) was added to have a concentration of 0.22%. Thereafter, the pH was adjusted to 8.3 by adding an aqueous 5% sodium hydroxide solution and further adjusted to 8.4 with aqueous ammonia. The molar ratio of $Na^+$ ion and $NH_4$+ion used here was 1:2.3. To 1 kg of the resulting solution, 0.15 ml of a 7% aqueous solution of benzoisothiazolinone sodium salt was added to prepare an SBR latex solution.

(SBR Latex: latex of -St(70.0)-Bu(27.0)-AA(3.0)-):

Tg: 22° C.

Average particle size: 0.1 μm, concentration: 43 mass %, equilibrium moisture content at 25° C. and 60% RH: 0.6 mass %, ion conductivity: 4.2 mS/cm (in the measurement of ion conductivity, the latex stock solution (43 mass %) was measured at 25° C. using a conductivity meter CM-30S manufactured by To a Denpa Kogyo K.K.), pH: 8.4.

SBR latexes different in Tg can be prepared in the same manner by appropriately changing the ratio of styrene and butadiene.

<Preparation of Coating Solution 2A for Emulsion Layer (Photosensitive Layer)>

The fatty acid silver salt dispersion prepared above (1,000 g), 276 ml of water, 33.2 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of the SBR latex (Tg: 22° C.) solution, 299 g of Reducing Agent Complex 1 Dispersion, 6 g of Development Accelerator 1 Dispersion, 9 ml of Aqueous Mercapto Compound 1 Solution and 27 ml of Aqueous Mercapto Compound 2 Solution were sequentially added. Immediately before the coating, 117 g of Emulsion 2A for Coating Solution was added and thoroughly mixed. The resulting coating solution for emulsion layer was transferred as it is to a coating die and coated.

The viscosity of the coating solution for emulsion layer obtained above was measured by a Brookfield viscometer manufactured by Tokyo Keiki Co., Ltd. and found to be 25 [mPa·s] at 40° C. (No. 1 rotor, 60 rpm).

The viscosity of the coating solution as measured at 25° C. by using RFS Field Spectrometer (manufactured by Rheometrics Far East Ltd.) was 230, 60, 46, 24 and 18 [mPa·s] at a shear rate of 0.1, 1, 10, 100 and 1,000 [1/sec], respectively.

The amount of zirconium in the coating solution was 0.38 mg per g of silver.

<Preparation of Coating Solution 2B for Emulsion Layer (Photosensitive Layer)>

Coating Solution 2B for Emulsion Layer was prepared in the same manner as in the preparation of Coating Solution 2A for Emulsion Layer (Photosensitive Layer) except for changing Emulsion 2A for Coating Solution to Emulsion 2B for Coating Solution.

<Preparation of Coating Solution 2C for Emulsion Layer (Photosensitive Layer)>

Coating Solution 2C for Emulsion Layer was prepared in the same manner as in the preparation of Coating Solution 2A for Emulsion Layer (Photosensitive Layer) except for changing Emulsion 2A for Coating Solution to Emulsion 2C for Coating Solution.

<Preparation of Coating Solution for Interlayer on Emulsion Surface>

A 5 mass % aqueous solution (27 ml) of Aerosol OT (produced by American Cyanamide), 135 ml of a 20 mass % aqueous solution of diammonium phthalate and water for making a total amount of 10,000 g were added to 1,000 g of polyvinyl alcohol PVA-205 (produced by Kuraray Co., Ltd.), 272 g of a 5 mass % dispersion of pigment and 4,200 ml of a 19 mass % solution of methyl methacrylate/styrene/butyl acrylate/hydroxyethyl methacrylate/acrylic acid copolymer (copolymerization ratio: 64/9/20/5/2 by mass) latex. The pH was adjusted to 7.5 with NaOH to prepare a coating solution for interlayer and then the coating solution for interlayer was transferred to a coating die to give a coverage of 9.1 ml/m$^2$.

The viscosity of the coating solution was measured at 40° C. by a Brookfield viscometer (No. 1 rotor, 60 rpm) and found to be 58 [mPa·s].

<Preparation of Coating Solution for First Protective Layer on Emulsion Surface>

In water, 64 g of inert gelatin was dissolved. Thereto, 80 g of a 27.5 mass % solution of methyl methacrylate/styrene/butyl acrylate/hydroxyethyl methacrylate/acrylic acid copolymer (copolymerization ratio: 64/9/20/5/2 by mass) latex, 23 ml of a 10 mass % methanol solution of phthalic acid, 23 ml of a 10 mass % aqueous solution of 4-methylphthalic acid, 28 ml of sulfuric acid in a concentration of 0.5 mol/liter, 5 ml of a 5 mass % aqueous solution of Aerosol OT (produced by American Cyanamide) and 0.5 g of phenoxyethanol, 0.1 g of benzoisothiazolinone were added and then water was added to make a total amount of 750 g to prepare a coating solution. Immediately before the coating, 26 ml of 4 mass % chrome alum was mixed by using a static mixer. Then, the coating solution was transferred to a coating die to give a coverage of 18.6 ml/m$^2$.

The viscosity of the coating solution was measured at 40° C. by a Brookfield viscometer (No. 1 rotor, 60 rpm) and found to be 20 [mPa·s].

<Preparation of Coating Solution for Second Protective Layer on Emulsion Surface>

In water, 80 g of inert gelatin was dissolved. Thereto, 102 g of a 27.5 mass % solution of methyl methacrylate/styrene/butyl acrylate/hydroxyethyl methacrylate/acrylic acid copolymer (copolymerization ratio: 64/9/20/5/2 by mass) latex, 3.2 ml of a 5 mass % solution of Fluorine-Containing Surfactant (F-1) (N-perfluorooctylsulfonyl-N-propylalanine potassium salt), 32 ml of a 2 mass % aqueous solution of Fluorine-Containing Surfactant (F-2) (polyethylene glycol mono(N-perfluorooctylsulfonyl-N-propyl-2-aminoethyl) ether [ethylene oxide average polymerization degree: 15]), 23 ml of a 5 mass % solution of Aerosol OT (produced by American Cyanamide), 4 g of polymethyl methacrylate fine particles (average particle size: 0.7 μm), 21 g of polymethyl methacrylate fine particles (average particle size: 4.5 μm), 1.6 g of 4-methylphthalic acid, 4.8 g of phthalic acid, 44 ml of sulfuric acid in a concentration of 0.5 mol/liter and 10 mg of benzoisothiazolinone were added and then water was added to make a total amount of 650 g. Immediately before the coating, 445 ml of an aqueous solution containing 4 mass % of chrome alum and 0.67 mass % of phthalic acid was mixed by using a static mixer to obtain a coating solution for surface protective layer and then the coating solution for surface protective layer was transferred to a coating die to give a coverage of 8.3 ml/m$^2$. The viscosity of the coating solution was measured at 40° C. by a Brookfield viscometer (No. 1 rotor, 60 rpm) and found to be 19 [mPa·s].

<Preparation of Photothermographic Material 2A>

In the back surface side of the undercoated support prepared above, the coating solution for antihalation layer and the coating solution for protective layer on the back surface were simultaneously coated one on another to give a coated gelatin amount of 0.44 g/m$^2$ and 1.7 g/m$^2$, respectively, and then dried to form a back layer.

On the surface opposite the back surface, an emulsion layer (using Coating Solution 2A for Emulsion Layer (Photosensitive Layer)), an interlayer, a first protective layer and a second protective layer were simultaneously coated one on another in this order from the undercoated surface by the slide bead coating method to prepare a photothermographic material sample. At this time, the temperature was adjusted such that the emulsion layer and the interlayer were 31° C., the first protective layer was 36° C. and the second protective layer was 37° C.

The coated amount (g/m$^2$) of each compound in the emulsion layer was as follows.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.97 |
| Reducing Agent Complex 1 | 1.41 |
| Development Accelerator 1 | 0.024 |
| Mercapto Compound 1 | 0.002 |
| Mercapto Compound 2 | 0.012 |
| Silver halide (as Ag) | 0.091 |

The coating and drying conditions were as follows.

The coating was performed at a speed of 160 m/min, the distance between the tip of coating die and the support was set to from 0.10 to 0.30 mm, and the pressure in the vacuum chamber was set lower by 196 to 882 Pa than the atmospheric pressure. The support was destaticized by ionized wind before the coating.

In the subsequent chilling zone, the coating solution was cooled with air at a dry bulb temperature of 10 to 20° C. Thereafter, the sample was transported by contact-free transportation and in a helical floating-type dryer, dried with drying air at a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The photothermographic material thus prepared had a matting degree of, in terms of the Bekk smoothness, 550 seconds on the photosensitive layer surface and 130 seconds on the back surface. Furthermore, the pH on the layer surface in the photosensitive layer side was measured and found to be 6.0.

<Preparation of Photothermographic Material 2B>

Photothermographic material 2B was prepared in the same manner as Photothermographic material 2A except for changing Coating Solution 2A for Emulsion Layer (Photosensitive Layer) to Coating Solution 2B for Emulsion Layer (Photosensitive Layer).

<Preparation of Photothermographic Material 2C>

Photothermographic material 2C was prepared in the same manner as Photothermographic material 2A except for changing Coating Solution 2A for Emulsion Layer (Photosensitive Layer) to Coating Solution 2C for Emulsion Layer (Photosensitive Layer).

(Evaluation of Photographic Performance)

The samples obtained each was cut into a size of 356×432 mm, wrapped with the following packaging material in an environment of 25° C. and 50% RH, stored at an ordinary temperature for 2 weeks and then evaluated as follows.

(Packaging Material)

Polyethylene (50 μm) containing PET (10 μm)/PE (12 μm)/aluminum foil (9 μm)/Ny (15 μm)/carbon (3%)

oxygen permeability: 0.02 ml/atm·m$^2$·25° C.·day moisture permeability: 0.10 g/atm·m$^2$·25° C.·day (Exposure of Photosensitive Material)

The photosensitive material was subjected to the following exposure treatment. In the exposure section of Fuji Medical Dry Laser Imager FM-DPL, a semiconductor laser NLHV3000E manufactured by Nichia Corporation was installed as a semiconductor laser light source and the beam diameter was narrowed down to about 100 μm. The photosensitive material was exposed for $10^{-6}$ seconds by changing the illuminance of laser light on the photosensitive material surface in the range from 1 to 1,000 mW/mm$^2$. The emission wavelength of laser light was 405 nm.

The samples each was heat-developed by using Fuji Medical Dry Laser Imager FM-DPL (with four panel heater sheets set at 112° C.-119° C.-121° C.-121° C. for 24 seconds in total). The obtained image was evaluated by a densitometer. The sensitivity was defined by a reciprocal of exposure amount of giving a density 1.5 higher than the minimum density and expressed by a relative value assuming that the sensitivity of Photothermographic material 2A was 100. The results are shown in Table 4. As apparent from Table 4, the photothermographic material using the emulsion of the present invention was verified to have remarkably high sensitivity.

TABLE 4

| | Emulsion | Sensitivity |
|---|---|---|
| Photothermographic material 2A | Emulsion 2A (Comparison) | 100 |
| Photothermographic material 2B | Emulsion 2B (Invention) | 110 |
| Photothermographic material 2C | Emulsion 2C (Invention) | 125 |

Example 3

<Preparation of Coating Solution 3A for Emulsion Layer (Photosensitive Layer)>

The fatty acid silver salt dispersion prepared above (1,000 g), 276 ml of water, 32.8 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of the SBR latex (Tg: 20° C.) solution, 155 g of Reducing Agent 2 Dispersion, 55 g of Hydrogen-Bonding Compound 1 Dispersion, 6 g of Development Accelerator 1 Dispersion, 2 g of Development Accelerator 2 Dispersion, 3 g of Development Accelerator 3

Dispersion, 2 g of Color Tone Adjusting Agent 1 Dispersion and 6 ml of Aqueous Mercapto Compound 2 Solution were sequentially added. Immediately before the coating, 117 g of Emulsion 2A for Coating Solution was added and thoroughly mixed. The resulting coating solution for emulsion layer was transferred as it is to a coating die and coated.

The viscosity of the coating solution for emulsion layer obtained above was measured by a Brookfield viscometer manufactured by Tokyo Keiki Co., Ltd. and found to be 40 [mPa·s] at 40° C. (No. 1 rotor, 60 rpm).

The viscosity of the coating solution as measured at 25° C. by using RFS Field Spectrometer (manufactured by Rheometrics Far East Ltd.) was 530, 144, 96, 51 and 28 [mPa·s] at a shear rate of 0.1, 1, 10, 100 and 1,000 [1/sec], respectively.

The amount of zirconium in the coating solution was 0.25 mg per g of silver.

<Preparation of Coating Solution 3B for Emulsion Layer (Photosensitive Layer)>

Coating Solution 3B for Emulsion Layer was prepared in the same manner as in the preparation of Coating Solution 3A for Emulsion Layer (Photosensitive Layer) except for changing Emulsion 2A for Coating Solution to Emulsion 2B for Coating Solution.

<Preparation of Coating Solution 3C for Emulsion Layer (Photosensitive Layer)>

Coating Solution 3C for Emulsion Layer was prepared in the same manner as in the preparation of Coating Solution 3A for Emulsion Layer (Photosensitive Layer) except for changing Emulsion 2A for Coating Solution to Emulsion 2C for Coating Solution.

<Preparation of Photothermographic material 3A>

Photothermographic material 3A was prepared in the same manner as Photothermographic material 2A except that in the preparation of Photothermographic material 2A, Coating Solution 2A for Emulsion Layer was changed to Coating Solution 3A for Emulsion Layer, Yellow Dye Compound 1 was eliminated from the antihalation layer, and Fluorine-Containing Surfactants F-1, F-2, F-3 and F-4 in the back surface protective layer and emulsion surface protective layer were changed to F-5, F-6, F-7 and F-8, respectively.

The coated amount (g/m$^2$) of each compound in this emulsion layer was as follows.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.67 |
| Reducing Agent 2 | 0.81 |
| Hydrogen-Bonding Compound 1 | 0.30 |
| Development Accelerator 1 | 0.024 |
| Development Accelerator 2 | 0.010 |
| Development Accelerator 3 | 0.015 |
| Color Tone Adjusting Agent 1 | 0.010 |
| Mercapto Compound 2 | 0.002 |
| Silver halide (as Ag) | 0.091 |

<Preparation of Photothermographic Material 3B>

Photothermographic material 3B was prepared in the same manner as Photothermographic material 3A except for changing Coating Solution 3A for Emulsion Layer (Photosensitive Layer) to Coating Solution 3B for Emulsion Layer (Photosensitive Layer).

<Preparation of Photothermographic Material 3C>

Photothermographic material 3C was prepared in the same manner as Photothermographic material 3A except for changing Coating Solution 3A for Emulsion Layer (Photosensitive Layer) to Coating Solution 3C for Emulsion Layer (Photosensitive Layer).

Chemical structures of the compounds used in Examples 2 and 3 of the present invention are shown below.

Chemical Sensitizer 1:

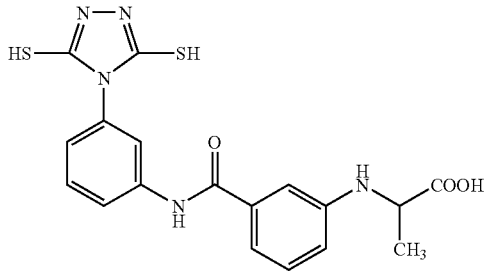

Base Precursor Compound 1:

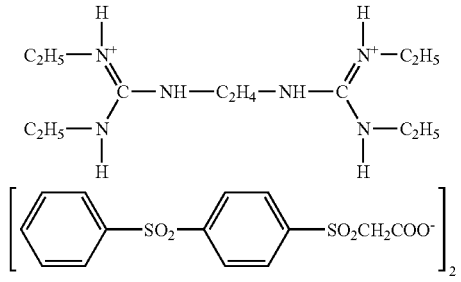

Cyanine Dye Compound 1:

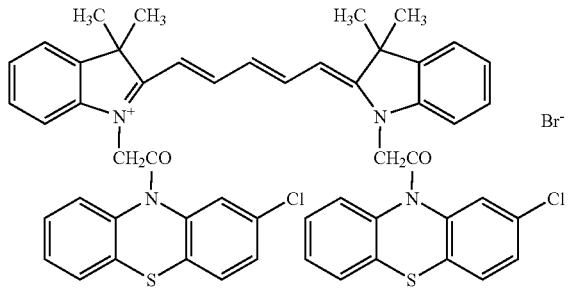

Blue Dye Compound-1:
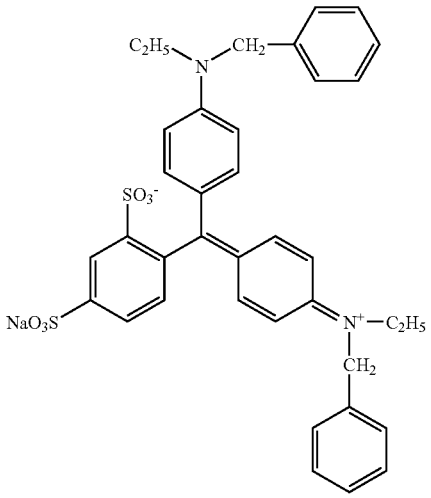
Yellow Dye Compound 1:
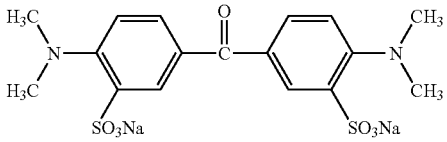
Reducing Agent Complex 1:
A 1:1compplex of
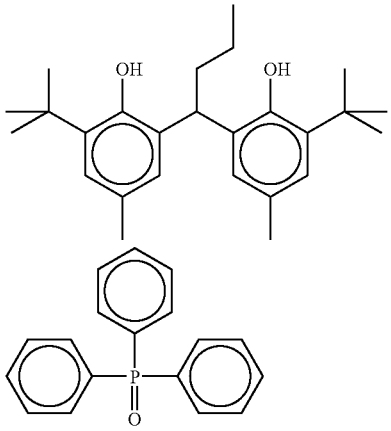
and
Reducing Agent 2:
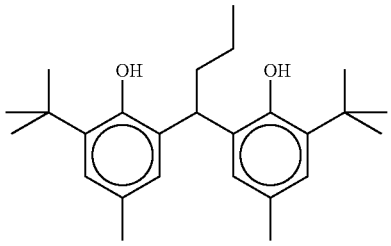
Hydrogen-Bonding Compound 1:
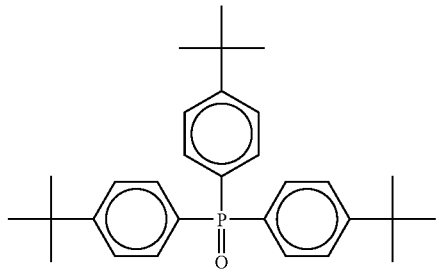
Polyhalogen Compound 1:
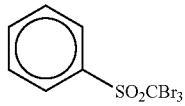
Polyhalogen Compound 2:
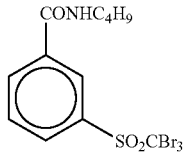
Mercapto Compound 1:
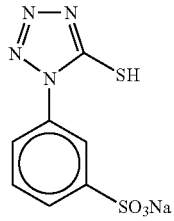
Mercapto Compound 2:
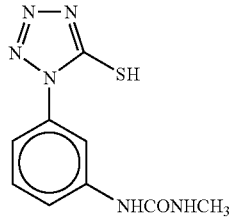

Phthalazine Compound 1:

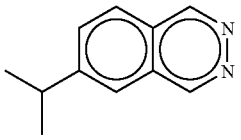

Development Accelerator 1:

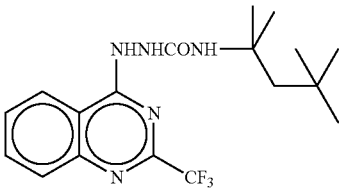

Development Accelerator 2:

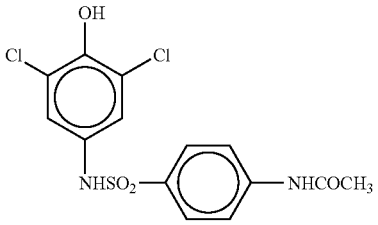

Development Accelerator 3:

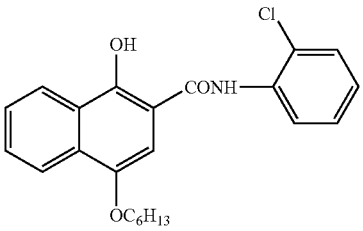

Color Tone Adjusting Agent 1:

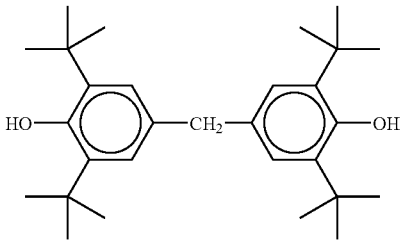

(F-1)

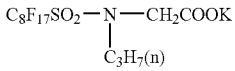

(F-2)

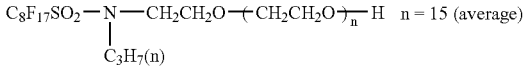

(F-3)

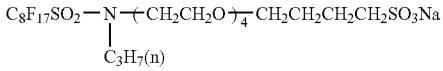

(F-4)

$C_8F_{17}SO_3K$ (F-5)

$CF_3(CF_2)_nCH_2CH_2SCH_2CH_2COOLi$
a mixture of n = 5 to 11

(F-6)

$CF_3(CF_2)_nCH_2CH_2O(CH_2CH_2O)_mH$
a mixture of n = 5 to 11, m = 5 to 15

(F-7)

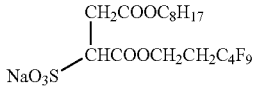

(F-8)

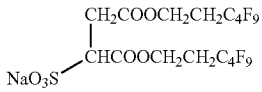

(Evaluation of Photographic Performance)

The samples obtained each was cut into a size of 356×432 mm, wrapped with the following packaging material in an environment of 25° C. and 50%, stored at an ordinary temperature for 2 weeks and then evaluated as follows.

(Packaging Material)

Polyethylene (50 μm) containing PET (10 μm)/PE (12 μm)/aluminum foil (9 μm)/Ny (15 μm)/carbon (3%)

oxygen permeability: 0.02 ml/atm·$m^2$·25° C.·day moisture permeability: 0.10 g/atm·$m^2$·25° C.·day (Exposure of Photosensitive Material)

The photosensitive material was subjected to the following exposure treatment. In the exposure section of Fuji Medical Dry Laser Imager FM-DPL, a semiconductor laser NLHV3000E manufactured by Nichia Corporation was installed as a semiconductor laser light source and the beam diameter was narrowed down to about 100 μm. The photosensitive material was exposed for $10^{-6}$ seconds by setting the illuminance of laser light on the photosensitive material surface to 0 or changing it in the range from 1 to 1,000 mW/$mm^2$. The emission wavelength of laser light was 405 nm.

The samples each was heat-developed by using Fuji Medical Dry Laser Imager FM-DPL (with four panel heater sheets set at 112° C.-119° C.-121° C.-121° C. for 14 seconds in total). The obtained image was evaluated by a densitometer. The sensitivity was defined by a reciprocal of exposure amount of giving a density 3.0 higher than the minimum density and expressed by a relative value assuming that the sensitivity of Photothermographic material 3A was 100. The results are shown in Table 5. As apparent from Table 5, the photothermographic material using the emulsion of the present invention was verified to have remarkably high sensitivity.

TABLE 5

| | Emulsion | Sensitivity |
|---|---|---|
| Photothermographic material 3A | Emulsion 2A (Comparison) | 100 |
| Photothermographic material 3B | Emulsion 2B (Invention) | 121 |
| Photothermographic material 3C | Emulsion 2C (Invention) | 136 |

According to the present invention, a high silver iodide photographic emulsion having high sensitivity and a narrow size distribution can be provided and a photothermographic material using the emulsion can also be provided.

This application is based on Japanese patent application JP 2002-299173, filed on Oct. 11, 2002, the entire content of which is hereby incorporated by reference, the same as if set forth at length.

What is claimed is:

1. A photosensitive silver halide photographic emulsion having a silver iodide content of 90 mol % or more, wherein the average grain size (R) and the average crystallite size (r) of silver halide emulsion grains in the emulsion satisfy the relationship of $1 \leqq R/r < 2$.

2. The photosensitive silver halide photographic emulsion as described in claim 1, wherein the average grain size (R) and the average crystallite size (r) of silver halide emulsion grains in the emulsion satisfy the relationship of $1 \leqq R/r < 1.4$.

3. The photosensitive silver halide photographic emulsion as described in claim 1, wherein the silver halide emulsion grains in the emulsion contain silver halide emulsion grains having a β-type crystal structure in an amount of 50% or more.

4. The photosensitive silver halide photographic emulsion as described in claim 1, wherein the average grain size (R) of the emulsion grains is 0.2 μm or less.

5. The photosensitive silver halide photographic emulsion as described in claim 4, wherein the average grain size (R) of the emulsion grains is 0.001 μm or more.

6. The photosensitive silver halide photographic emulsion as described in claim 1, wherein the coefficient of variation in the average grain size is 20% or less.

7. A photothermographic material comprising a support having on the same surface thereof a photosensitive silver halide photographic emulsion, a photo-insensitive organic silver salt, a heat developer and a binder, wherein the photosensitive silver halide photographic emulsion has a silver iodide content of 90 mol % or more, and wherein the average grain size (R) and the average crystallite size (r) of silver halide emulsion grains in the emulsion satisfy the relationship of $1 \leqq R/r < 2$.

8. The photothermographic material as described in claim 7, wherein the average grain size (R) and the average crystallite size (r) of silver halide emulsion grains in the emulsion satisfy the relationship of $1 \leqq R/r < 1.4$.

9. The photothermographic material as described in claim 7, wherein the silver halide emulsion grains in the emulsion contain silver halide emulsion grains having a β-type crystal structure in an amount of 50% or more.

10. The photothermographic material as described in claim 7, wherein the average grain size (R) of the emulsion grains is 0.2 μm or less.

11. The photothermographic material as described in claim 10, wherein the average grain size (R) of the emulsion grains is 0.001 μm or more.

12. The photothermographic material as described in claim 7, wherein the coefficient of variation in the average grain size is 20% or less.

13. The photothermographic material as described in claim 7, wherein said photosensitive silver halide photographic emulsion has a silver iodide content of 92 mol % or more.

14. The photothermographic material as described in claim 7, wherein said photosensitive silver halide photographic emulsion has a silver iodide content of 95 mol % or more.

* * * * *